US012305937B2

(12) United States Patent
Miyawaki et al.

(10) Patent No.: US 12,305,937 B2
(45) Date of Patent: May 20, 2025

(54) HEAT EXCHANGER AND AIR-CONDITIONING APPARATUS EMPLOYING THE SAME

(71) Applicant: Mitsubishi Electric Corporation, Tokyo (JP)

(72) Inventors: Kosuke Miyawaki, Tokyo (JP); Yoji Onaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 422 days.

(21) Appl. No.: 17/921,188

(22) PCT Filed: Jun. 8, 2020

(86) PCT No.: PCT/JP2020/022543
§ 371 (c)(1),
(2) Date: Oct. 25, 2022

(87) PCT Pub. No.: WO2021/250743
PCT Pub. Date: Dec. 16, 2021

(65) Prior Publication Data
US 2023/0168047 A1 Jun. 1, 2023

(51) Int. Cl.
*F28F 9/02* (2006.01)
*F28D 1/053* (2006.01)
(Continued)

(52) U.S. Cl.
CPC ..... *F28F 9/0212* (2013.01); *F28D 1/053* (2013.01); *F28F 1/02* (2013.01); *F28F 9/26* (2013.01)

(58) Field of Classification Search
CPC .... F28F 9/09212; F28F 9/0209; F28F 9/0265; F28F 9/028
See application file for complete search history.

(56) References Cited

U.S. PATENT DOCUMENTS 6,161,616 A * 12/2000 Haussmann ..... F28D 1/05391 165/174
6,688,137 B1 * 2/2004 Gupte ..... F28F 9/0265 62/515
(Continued)

FOREIGN PATENT DOCUMENTS

DE 102007016050 A1 * 10/2007 ..... F28D 1/05391
JP 11337293 A * 12/1999 ..... F28D 1/05375
(Continued)

OTHER PUBLICATIONS

International Search Report and Written Opinion mailed on Aug. 4, 2020, received for PCT Application PCT/JP2020/022543, filed on Jun. 8, 2020, 9 pages including English Translation.

*Primary Examiner* — Devon Lane
(74) *Attorney, Agent, or Firm* — XSENSUS LLP

(57) ABSTRACT

A heat exchanger includes a plurality of flat tubes, and a header. A flow passage provided inside the header includes a plurality of partition portions each provided between the adjacent flat tubes, a plurality of insertion portions formed between the adjacent partition portions, a first communication passage allowing one ends of the adjacent insertion portions to communicate with each other, and a second communication passage allowing an other ends of the adjacent insertion portions to communicate with each other. A cross-sectional area of the first communication passage is larger than a cross-sectional area of the second communication passage, and the first communication passage is provided with a first refrigerant inlet connected to the flow passage and allowing the refrigerant to flow into the header. Thus, a heat exchanger performance can be improved by reducing a refrigerant pressure loss and by achieving uniform distribution of the refrigerant.

12 Claims, 23 Drawing Sheets

(51) Int. Cl.
*F28F 1/02* (2006.01)
*F28F 9/26* (2006.01)

(56) References Cited

U.S. PATENT DOCUMENTS

| | | | | |
|---|---|---|---|---|
| 2005/0262872 | A1* | 12/2005 | Sacks | F28F 9/026 62/500 |
| 2016/0238322 | A1* | 8/2016 | Inoue | F28F 9/028 |
| 2017/0211886 | A1* | 7/2017 | Morimura | F28F 9/027 |

FOREIGN PATENT DOCUMENTS

| | | | | | |
|---|---|---|---|---|---|
| JP | 2005188785 | A | * | 7/2005 | |
| JP | 2005337669 | A | * | 12/2005 | F28D 1/05375 |
| JP | 2007183076 | A | * | 7/2007 | F25B 39/00 |
| JP | 2009144997 | A | * | 7/2009 | |
| JP | 2011075165 | A | * | 4/2011 | F28D 1/05383 |
| JP | 2014037899 | A | * | 2/2014 | |
| JP | 2014066502 | A | * | 4/2014 | |
| JP | 2015-68623 | A | | 4/2015 | |
| JP | 2017-133820 | A | | 8/2017 | |
| WO | WO-2007094422 | A1 | * | 8/2007 | F25B 39/028 |

* cited by examiner

FIG. 7
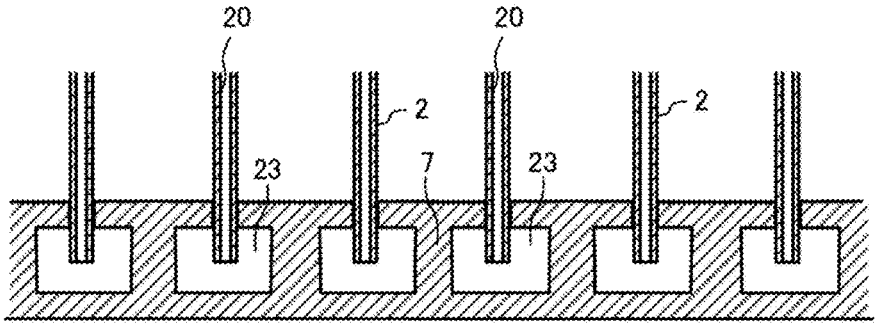
FIG. 8 COMPERATIVE EXAMPLE
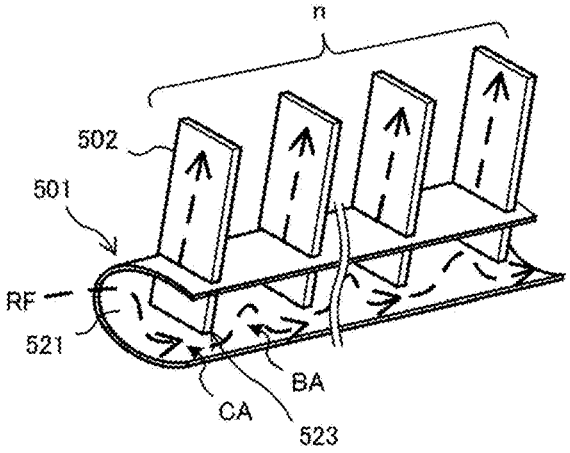
FIG. 9
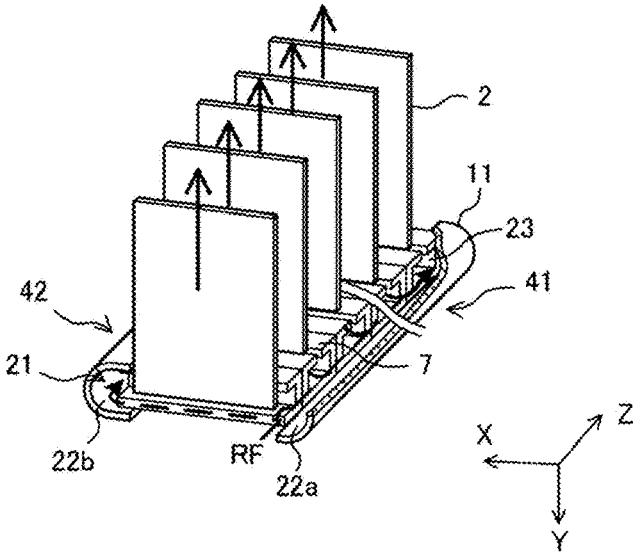

COMPERATIVE EXAMPLE

FIG. 24 COMPERATIVE EXAMPLE

HEAT EXCHANGER AND AIR-CONDITIONING APPARATUS EMPLOYING THE SAME

CROSS-REFERENCE TO RELATED APPLICATION

The present application is based on PCT filing PCT/JP2020/022543, filed Jun. 8, 2020, the entire contents of which are incorporated herein by reference.

TECHNICAL FIELD

The present disclosure relates to a heat exchanger and an air-conditioning apparatus using the same.

BACKGROUND ART

A heat exchanger functioning as a condenser mounted on an indoor unit of an air-conditioning apparatus is known. A pressure of liquid refrigerant condensed at the heat exchanger is reduced by an expansion valve to be brought into a two-phase gas-liquid state in which gas refrigerant and liquid refrigerant are mixed. Then, the liquid refrigerant of the refrigerant in the two-phase gas-liquid state is evaporated at the heat exchanger functioning as an evaporator mounted on an outdoor unit, and the refrigerant in the two-phase gas-liquid state becomes low-pressure gas refrigerant. Thereafter, the low-pressure gas refrigerant flowing from the heat exchanger flows into the compressor mounted on the outdoor unit, is compressed to become high-temperature and high-pressure gas refrigerant, and is discharged from the compressor again. This cycle is then repeated.

A heat exchanger employing a plurality of heat transfer tubes having a flat cross-section is known that aims to improve energy efficiency by reducing ventilation resistance and save refrigerant by reducing volume of the tube. However, when the header is downsized to save the refrigerant, a flow resistance in the header increases and a heat exchanger performance deteriorates. Thus, it is difficult to achieve both performance improvement and refrigerant saving.

In order to achieve both performance improvement and refrigerant saving, a heat exchanger including two main header chambers extending substantially in a parallel with the heat transfer tubes, and a plurality of sub-header chambers branched horizontally from the main header chambers and arranged side by side in the parallel direction of the heat transfer tubes, has been proposed (see, for example Patent Literature 1). In this case, by providing the header that allows the refrigerant flowing into the main header chamber to flow out to refrigerant pipes respectively connected to the plurality of sub header chambers, a uniform distribution of the refrigerant is achieved.

CITATION LIST

Patent Literature

Patent Literature 1: Japanese Unexamined Patent Application Publication No. 2007-183076

SUMMARY OF INVENTION

Technical Problem

However, in the heat exchanger of Patent Literature 1, when a flow passage of the header is made smaller in order to reduce an amount of refrigerant, a pressure loss of the refrigerant increases due to increase of flow resistance and the refrigerant in the two-phase gas-liquid state is distributed non-uniformly. This results in a decrease in the heat exchanger performance.

The present disclosure has been made to overcome the above-mentioned problems, to provide a heat exchanger and an air-conditioning apparatus employing the heat exchanger in which the heat exchanger performance can be improved by reducing the refrigerant pressure loss and by achieving uniform distribution of the refrigerant.

Solution to Problem

A heat exchanger according to the present disclosure includes a plurality of flat tubes extending in a first direction and arranged with spacing from each other in a second direction perpendicular to the first direction, a cross-section of each of the plurality of flat tubes in the second direction being an elongated shape, and a header extending in the second direction and connecting end portions of the adjacent flat tubes of the plurality of flat tubes in the first direction. The header is having inside a flow passage through which refrigerant flows. The flow passage includes a plurality of partition portions each provided between the adjacent flat tubes and configured to block at least a part of the flow passage between the adjacent flat tubes to prevent the refrigerant from flowing in the second direction, a plurality of insertion portions formed between the adjacent partition portions, each of the plurality of insertion portions forming a space where the refrigerant flows in a third direction perpendicular to the first direction and the second direction, each of the plurality of flat tubes being inserted in to each of the plurality of insertion portions, a first communication passage allowing one ends of the adjacent insertion portions in the third direction to communicate with each other, and a second communication passage allowing an other ends of the adjacent insertion portions in the third direction to communicate with each other. A cross-sectional area of the first communication passage, of a cross-section perpendicular to the second direction is larger than a cross-sectional area of the second communication passage, of a cross-section perpendicular to the second direction. The first communication passage is provided with a first refrigerant inlet connected to the flow passage and allowing the refrigerant to flow into the header.

An air-conditioning apparatus employing the heat exchanger according to the present disclosure includes a heat pump type refrigerant circuit which includes at least a compressor, a condenser, an expansion valve and an evaporator. The condenser or the evaporator is the heat exchanger as described above.

Advantageous Effects of Invention

According to the present disclosure, the flow passage of the header includes a plurality of partition portions each provided between the adjacent flat tubes and configured to block at least a part of the flow passage between the adjacent flat tubes, a plurality of insertion portions formed between the adjacent partition portions, each of the plurality of insertion portions forming a space where the refrigerant flows, each of the plurality of flat tubes being inserted in to each of the plurality of insertion portions, a first communication passage allowing one ends of the adjacent insertion portions in the third direction to communicate with each other, and a second communication passage allowing an other ends of the adjacent insertion portions in the third direction to communicate with each other. In addition, a cross-sectional area of the first communication passage is larger than a cross-sectional area of the second communication passage and the first communication passage is provided with a first refrigerant inlet connected to the flow passage and allowing the refrigerant to flow into the header. According to this configuration, the refrigerant pressure loss due to expansion and contraction of the refrigerant flow that occurs in the insertion portion is reduced and increase of the pressure loss when a diameter of the flow passage is made smaller can be suppressed.

Further, the header includes the first refrigerant connected to the flow passage in at least one of two regions when the header is divided by a center plane passing through the center of a third direction which intersects the first direction and the second direction of the flat tube, and a passage cross-sectional area of the first communication passage in which the first refrigerant inlet is provided is larger than that of the second communication passage. In other words, the header has a configuration in which a communication passage in which the refrigerant is transported mainly by inertia force from the refrigerant inlet to the insertion portion of the flat tube due to a relatively large passage cross-sectional area, and a communication passage in which gas and liquid are exchanged mainly by diffusion through the insertion portion of the flat tube due to a relatively small passage cross-sectional area. According to this configuration, the non-uniform distribution of the refrigerant due to changes in a flow velocity of the refrigerant is mitigated, and the heat exchanger performance is improved, thereby improving an energy efficiency of an air-conditioning apparatus equipped with the heat exchanger. Thus, the heat exchanger performance can be improved by reducing the refrigerant pressure loss and by achieving uniform distribution of the refrigerant.

BRIEF DESCRIPTION OF DRAWINGS

FIG. 7 is a schematic view showing a cross-section taken along C-C of the header in FIG. 4.

FIG. 8 is a perspective view schematically showing a cross-section of the header for explaining a flow of refrigerant in the heat exchanger of Comparative Example.

FIG. 9 is a perspective view, partially in cross-section, of the header of the heat exchanger in FIG. 1 for explaining a flow of the refrigerant of the header according to Embodiment 1.

DESCRIPTION OF EMBODIMENTS

Figure 1:
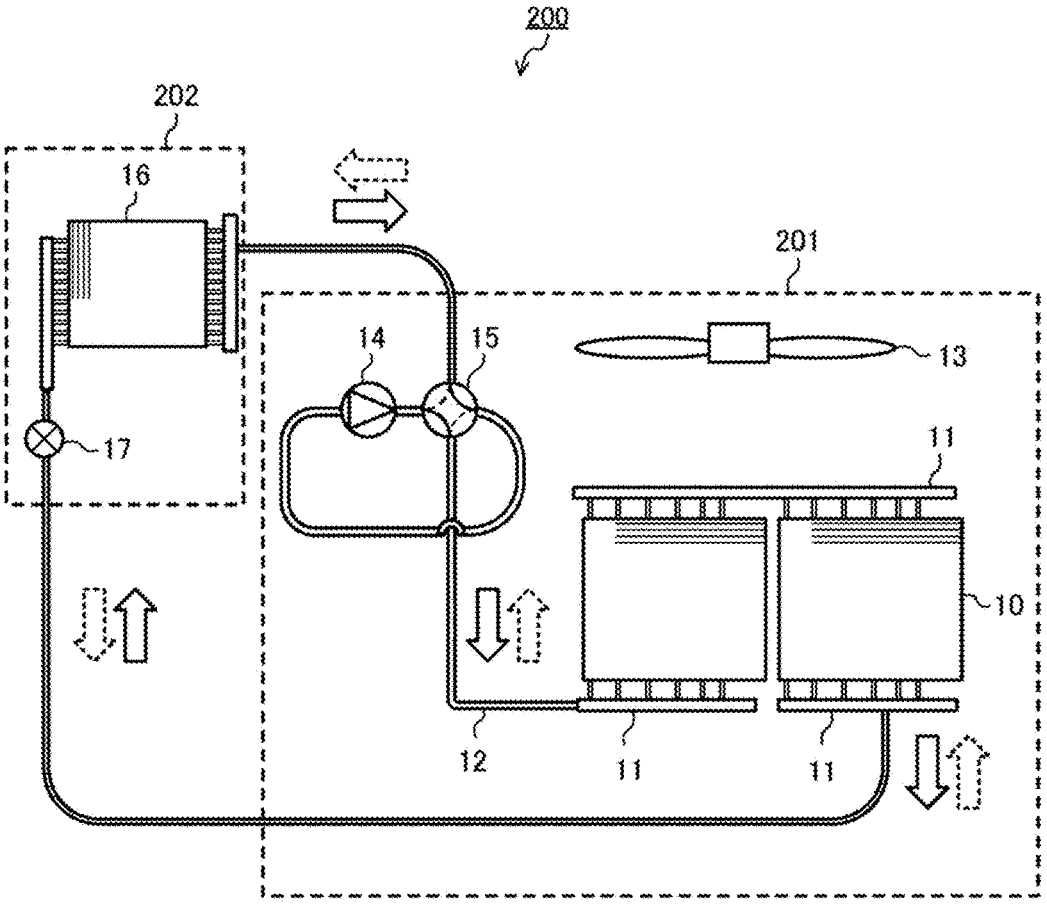
FIG. 1 is a refrigerant circuit diagram showing an example of an air-conditioning apparatus according to Embodiment 1.

Embodiments will be described hereinafter with reference to the drawings. In the drawings, components referred to with the same reference signs are the same or correspond to each other, and this is common throughout the entire specification. The components shown in the entire specification are only examples and the present disclosure is not limited by the embodiments described below. In addition, the relationship of sizes of the components in the drawings may differ from that of actual ones.

Embodiment 1

<Configuration of Air-Conditioning Apparatus 200>

First, an air-conditioning apparatus according to Embodiment 1 will be described. FIG. 1 is a refrigerant circuit diagram showing an example of an air-conditioning apparatus 200 according to Embodiment 1. In FIG. 1, a flow of refrigerant in a cooling operation is indicated by a broken line arrow, and a flow of refrigerant in a heating operation is indicated by a solid line arrow.

As shown in FIG. 1, the air-conditioning apparatus 200 includes an outdoor unit 201 and an indoor unit 202. The outdoor unit 201 includes a heat exchanger 10 as an outdoor heat exchanger, an outdoor fan 13, a compressor 14, and a four-way valve 15. The indoor unit 202 includes an indoor heat exchanger 16, an expansion device 17, and an indoor fan (not shown). The compressor 14, the four-way valve 15, the heat exchanger 10, the expansion device 17, and the indoor heat exchanger 16 are connected by a refrigerant pipe 12 to form a refrigerant circuit.

The compressor 14 is configured to compress refrigerant. The refrigerant compressed by the compressor 14 is discharged and supplied to the four-way valve 15. The compressor 14 may be, for example, a rotary compressor, a scroll compressor, a screw compressor, or a reciprocating compressor and the like.

The heat exchanger 10 functions as a condenser during a heating operation, and functions as an evaporator during a cooling operation. Although details will be described later, the heat exchanger 10 of Embodiment 1 is a fin-and-tube type heat exchanger which includes a plurality of fins 1 and a plurality of flat tubes 2. Each of the flat tubes 2 is a heat transfer tube with an elongated shape. In the heat exchanger 10, the fins 1 and the flat tubes 2 extend in a first direction Y which is an elongated direction of the flat tubes 2, and arranged alternately side by side in a second direction Z perpendicular to the first direction Y. Each flat tube 2 has a flat cross-section perpendicular to the first direction Y and a plurality of refrigerant passages 20 through which refrigerant flows and which is formed inside the flat tube 2. A header 11 is provided at each end portion of the flat tubes 2 in the first direction Y (see FIG. 2).

The expansion device 17 is configured to reduce a pressure of the refrigerant flowing from the heat exchanger 10 or the indoor heat exchanger 16 by expanding the refrigerant. The expansion device 17 may be, for example, an electric expansion valve which can control a flow rate of the refrigerant. As the expansion device 17, not only the electric expansion valve, but also a mechanical expansion valve employing a diaphragm as a pressure receiving portion, a capillary tube, or the like can be used.

The indoor heat exchanger 16 functions as an evaporator during the heating operation, and functions as a condenser during the cooling operation. The indoor heat exchanger 16 may be, for example, a fin-and-tube type heat exchanger, a microchannel heat exchanger, a shell-and-tube type heat exchanger, a heat-pipe type heat exchanger, a double-tube type heat exchanger, a plate heat exchanger, or the like.

The four-way valve 15 is configured to switch a flow of the refrigerant between the heating operation and the cooling operation. The four-way valve 15 switches a flow of the refrigerant to connect a discharge port of the compressor 14 with the heat exchanger 10 and to connect an inlet port of the compressor 14 with the indoor heat exchanger 16 during the heating operation. In addition, the four-way valve 15 switches the flow of the refrigerant to connect the discharge port of the compressor 14 with the indoor heat exchanger 16 and to connect the inlet port of the compressor 14 with the heat exchanger 10 during the cooling operation.

The outdoor fan 13 is attached to the heat exchanger 10 and configured to supply air, which is heat exchange fluid, to the heat exchanger 10.

The indoor fan (not shown) is attached to the indoor heat exchanger 16 and configured to supply air, which is heat exchange fluid, to the indoor heat exchanger 16.

<Operation of Air-Conditioning Apparatus 200>

Next, an operation of the air-conditioning apparatus 200 will be described together with a flow of the refrigerant. First, the cooling operation performed by the air-conditioning apparatus 200 will be described. The flow of the refrigerant during the cooling operation is shown by the solid line arrows in FIG. 1. Here, an operation of the air-conditioning apparatus 200 is described with a case where the heat exchange fluid is air and the heat exchanged fluid is refrigerant as an example.

As shown in FIG. 1, by driving the compressor 14, refrigerant in a gas state of high-temperature and high-pressure is discharged from the compressor 14. Hereinafter, the refrigerant flows in accordance with the broken line arrows. The high-temperature and high-pressure gas refrigerant (single phase) discharged from the compressor 14 flows into the heat exchanger 10 which functions as a condenser through the four-way valve 15. In the heat exchanger 10, heat is exchanged between the high-temperature and high-pressure gas refrigerant that flows into the heat exchanger 10 and the air supplied by the outdoor fan 13. By this heat exchange, the high-temperature and high-pressure gas refrigerant is condensed and becomes high-pressure liquid refrigerant (single phase).

The high-pressure liquid refrigerant supplied from the heat exchanger 10 becomes two-phase state refrigerant including low pressure gas refrigerant and liquid refrigerant at the expansion device 17. The two-phase state refrigerant flows into the indoor heat exchanger 16 which functions as an evaporator. In the indoor heat exchanger 16, heat is exchanged between the two-phase state refrigerant flows into the indoor heat exchanger 16 and the air supplied by the indoor fan (not shown). By this heat exchange, liquid refrigerant in the two-phase state refrigerant is evaporated and the two-phase state refrigerant becomes low-pressure gas refrigerant (single phase). An indoor space is cooled by this heat exchange. The low-pressure gas refrigerant supplied from the indoor heat exchanger 16 flows into the compressor 14 via the four-way valve 15. The refrigerant flowing into the compressor 14 is compressed and again discharged from the compressor 14 as the high-temperature and high-pressure gas refrigerant. This cycle is then repeated.

Next, the heating operation performed by the air-conditioning apparatus 200 will be described. The flow of the refrigerant during the heating operation is indicated by the broken line arrows in FIG. 1.

As shown in FIG. 1, by driving the compressor 14, refrigerant in a gas state of high-temperature and high-pressure is discharged from the compressor 14. Hereinafter, the refrigerant flows in accordance with the broken line arrows.

The high-temperature and high-pressure gas refrigerant (single phase) discharged from the compressor 14 flows into the indoor heat exchanger 16 which functions as a condenser through the four-way valve 15. In the indoor heat exchanger 16, heat is exchanged between the high-temperature and high-pressure gas refrigerant that flows into the indoor heat exchanger 16 and the air supplied by the indoor fan (not shown). By this heat exchange, the high-temperature and high-pressure gas refrigerant is condensed and becomes high-pressure liquid refrigerant (single phase). The indoor space is heated by this heat exchange.

The high-pressure liquid refrigerant supplied from the indoor heat exchanger 16 becomes two-phase state refrigerant including low pressure gas refrigerant and liquid refrigerant at the expansion device 17. The two-phase state refrigerant flows into the heat exchanger 10 which functions as an evaporator. In the heat exchanger 10, heat is exchanged between the two-phase state refrigerant flows into the heat exchanger 10 and the air supplied by the outdoor fan 13. By this heat exchange, the liquid refrigerant in the two-phase state refrigerant is evaporated and the two-phase state refrigerant becomes low-pressure gas refrigerant (single phase).

The low-pressure gas refrigerant supplied from the heat exchanger 10 flows into the compressor 14 via the four-way valve 15. The refrigerant flowing into the compressor 14 is compressed and again discharged from the compressor 14 as the high-temperature and high-pressure gas refrigerant. This cycle is then repeated.

During the cooling operation and heating operation described above, when the refrigerant flows into the compressor 14 in a liquid state, liquid compression is caused. This results in failure of the compressor 14. Therefore, it is desirable that the refrigerant flowing out of the indoor heat exchanger 16 during the cooling operation or the heat exchanger 10 during the heating operation is gas refrigerant (single phase).

Here, at the evaporator, water in the air is condensed when heat exchange is performed between the air supplied from the fan and the refrigerant flowing inside the heat transfer tubes constituting the evaporator, and water droplets are generated on a surface of the evaporator. The water droplets generated on the surface of the evaporator are dropped downward along surfaces of fins and the heat transfer tubes, and ejected below the evaporator as drain water.

Since the heat exchanger 10 functions as the evaporator during the heating operation, water in the air may cause frost on the heat exchanger 10 in a low outdoor temperature condition. Therefore, the air-conditioning apparatus 200 is configured to perform a "defrosting operation" to remove the frost when an outdoor temperature is equal to or lower than a certain temperature (e.g., 0 degree C.).

The "defrosting operation" is an operation in which hot gas (high-temperature and high-pressure gas refrigerant) is supplied from the compressor 14 to the heat exchanger 10 to prevent frost from forming on the heat exchanger 10, which functions as the evaporator. The defrosting operation may be performed when a duration of the heating operation reaches a predetermined value (e.g., 30 minutes). The defrosting operation may be performed before the heating operation when a temperature of the heat exchanger 10 is equal to or lower than a certain temperature (e.g., minus 6 degree C.). The frost and ice formed on the heat exchanger 10 are melted by the hot gas supplied to the heat exchanger 10 during the defrosting operation.

For example, a bypass refrigerant pipe (not shown) may be connected between the discharge port of the compressor 14 and the heat exchanger 10 so that the hot gas can be supplied directly from the compressor 14 to the heat exchanger 10 during the defrosting operation. Also, the discharge port of the compressor 14 may be connected to the heat exchanger 10 via a refrigerant flow switching device (e.g. the four-way valve 15) so that the hot gas can be supplied from the compressor 14 to the heat exchanger 10.

<Heat Exchanger 10>

Figure 2:
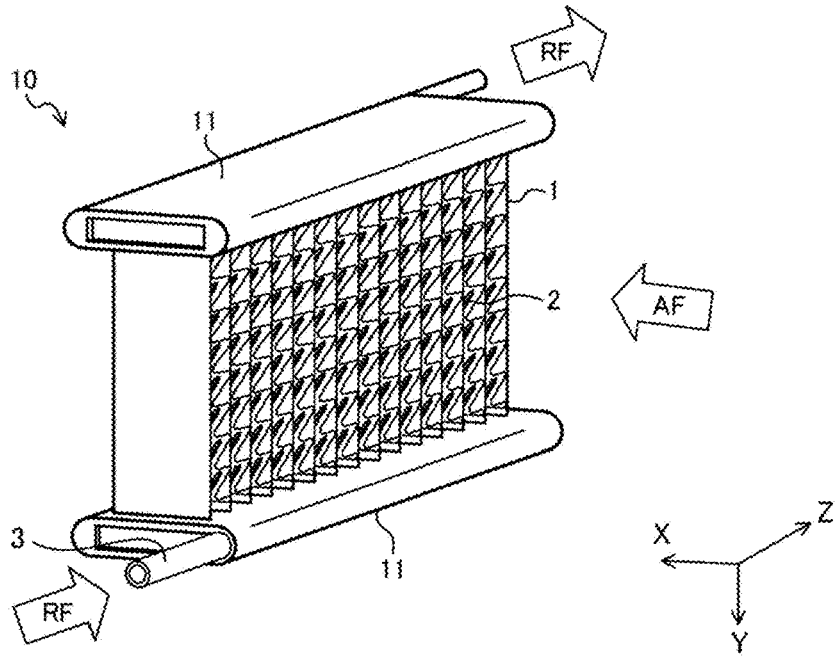
FIG. 2 is a perspective view showing an example of the heat exchanger mounted on the air-conditioning apparatus according to Embodiment 1.
Figure 3:
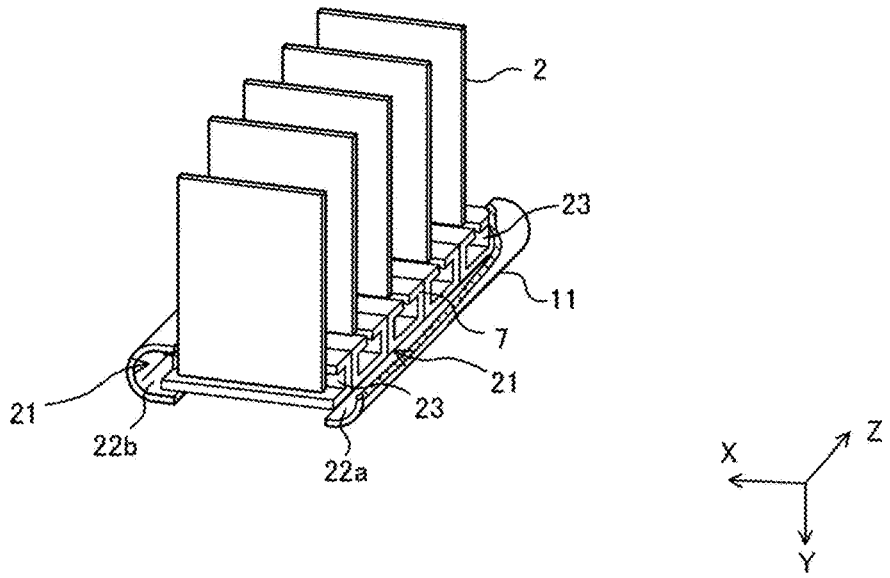
FIG. 3 is a perspective view, partially in cross-section, of the header of the heat exchanger in FIG. 2.
Figure 4:
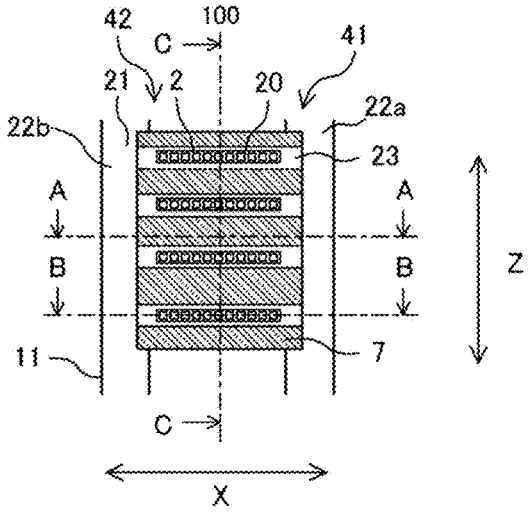
FIG. 4 is a schematic view showing a horizontal cross-section of the header in FIG. 2.
Figure 5:
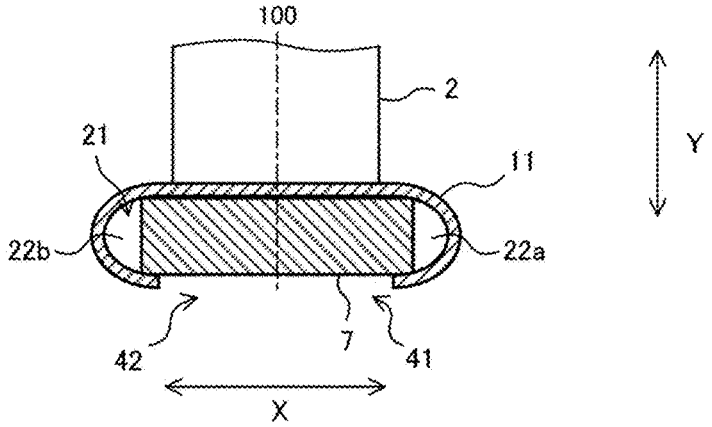
FIG. 5 is a schematic view showing a cross-section taken along A-A of the header in FIG. 4.
Figure 6:
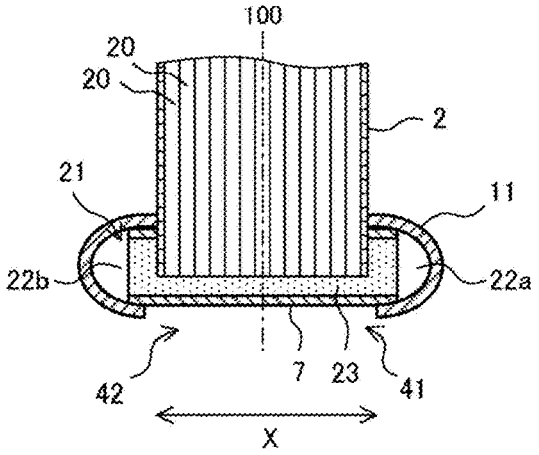
FIG. 6 is a schematic view showing a cross-section taken along B-B of the header in FIG. 4.

Next, the heat exchanger 10 mounted in the air-conditioning apparatus 200 of Embodiment 1 will be described. FIG. 2 is a perspective view showing an example of the heat exchanger 10 mounted on the air-conditioning apparatus 200 according to Embodiment 1. FIG. 3 is a perspective view, partially in cross-section, of the header 11 of the heat exchanger 10 in FIG. 2. FIG. 4 is a schematic view showing a horizontal cross-section of the header 11 in FIG. 2. FIG. 5 is a schematic view showing a cross-section taken along A-A of the header 11 in FIG. 4. FIG. 6 is a schematic view showing a cross-section taken along B-B of the header 11 in FIG. 4. FIG. 7 is a schematic view showing a cross-section taken along C-C of the header 11 in FIG. 4.

In FIG. 2, AF indicated by an arrow represents a flow direction of air supplied from the outdoor fan 13 (see FIG. 1) to the heat exchanger 10, RF indicated by arrows represents a flow direction of the refrigerant supplied to the heat exchanger 10. Each flat tube 2 is arranged so that its flat plane is parallel to the air flow direction AF and is spaced apart from each other so that the flat planes face each other. In other words, each flat tube 2 is arranged with spacing from each other in the second direction Z, which is a short-side direction of the elongated shape, in a cross-section perpendicular to the first direction Y. Regarding the flat cross-section of each flat tube 2, a length of its long-side direction may be described as width, a length of its short-side direction may be described as thickness, a long-side direction may be described as a width direction, and a short-side direction may be described as a thickness direction in the following description. The long-side direction (the width direction) of the cross-section of each flat tube 2, which intersects the first direction Y and the second direction Z of each flat tube 2, is a direction parallel to the flat plane, and hereinafter referred to as a third direction X. Further, in each of the drawings, the first direction Y, the second direction Z, and the third direction X are shown as being in a relationship orthogonal to each other. However, the first direction Y, the second direction Z, and the third direction X may intersect at an angle close to 90 degrees, for example, 80 degrees or the like.

In a typical heat exchanger 10, a large number of flat tubes 2 are connected to the header 11, the length of the first direction Y is larger than the length of the third direction X, and the length in the second direction Z is also larger than the length in the third direction X. Thus, the header 11 is long in the first direction Y.

As shown in FIG. 2, the heat exchanger 10 according to Embodiment 1 is, for example, a fin-and-tube type heat exchanger of a single-row structure, in which a plurality of fins 1 and a plurality of flat tubes 2 are alternately stacked along the second direction Z, which is the width direction of the heat exchanger 10. The fins 1 may be, for example, a plate fin connected to a large number of flat tubes 2, or may be a corrugated fin sandwiched between flat planes of two flat tubes 2. In the heat exchanger 10, the flat tubes 2 are spaced apart from each other and arranged side by side in the horizontal direction, which is the first direction Y, with extending in an up and down direction. The fins 1 are interposed between the adjacent flat tubes 2. The header 11 is connected to each end portion of the adjacent flat tubes 2 in the first direction Y, which is an elongation direction, so that the end portions of the flat tubes communicate with each other. The header 11 of Embodiment 1 described below may be provided at only one end portion of the flat tubes 2 in the first direction Y, or may be provided at both end portions of the flat tubes 2 in the first direction Y. In this embodiment, the flat tubes 2 are arranged side by side in the horizontal direction, which is the second direction Z, with extending in the up and down direction. However, the second direction Z is not limited thereto. For example, the flat tubes 2 may extend in the horizontal direction, which is the second direction Z, and may be spaced apart from each other and arranged side by side in a vertical direction, which is the first direction Y.

As shown in FIG. 3, the header 11 has a flow passage 21 for flowing refrigerant inside. In the flow passage 21, a plurality of partition portions 7 are arranged between each adjacent flat tubes 2. The partition portion 7 blocks at least a part of the flow passage 21 between the adjacent flat tubes 2. In the flow passage 21, a plurality of insertion portions 23 into which the flat tubes 2 are respectively inserted are provided. Each insertion portion 23 is a space formed between the adjacent partition portions 7. The number of the insertion portions 23 corresponds to the number of the flat tubes 2.

Here, as shown by a dotted chain line in FIGS. 4 and 5, a center plane 100 passing through a center of the third direction X intersecting the first direction Y and the second direction Z of the plurality of flat tubes 2 is assumed. Incidentally, since the center plane 100 is a plane parallel to the first direction Y and the second direction Z, it is indicated by the dotted chain line in FIGS. 4 and 5. When the header 11 is divided into two regions 41 and 42 with the center plane 100 as a boundary, communication passages 22*a* and 22*b* are respectively provided in the two regions to allow the adjacent insertion portions 23 to communicate with each other. The communication passages 22*a* and 22*b* are formed so as to be continuous in the second direction Z in which the flat tubes 2 are arranged in parallel, that is, in a direction in which the header 11 extends in each of the two regions 41 and 42. The communication passage 22*a* is connected to the refrigerant inlet 3 without via the insertion portion 23, and the communication passage 22*b* is connected to the refrigerant inlet 3 via the insertion portion 23. A passage cross-sectional area of the communication passage 22*a* is larger than a passage cross-sectional area of the communication passage 22*b* in the other region 42.

FIGS. 4 and 5 show a typical example of a configuration in which the communication passages 22*a* and 22*b* are provided at both sides of the flat tubes 2 in the third direction X in the flow passage 21 of the header 11. However, at least one communication passage in each of the two regions 41 and 42 is sufficient and it is not necessary to provide the communication passages on both sides of the third direction X. A plurality of communication passages 22*a* and 22*b* may be provided in either or both of the two regions 41 and 42.

Each flat tube 2 has a multi-hole tube structure with a plurality of adjacent refrigerant passages 20 inside. As shown in FIGS. 6 and 7, the communication passages 22*a* and 22*b* are connected to Each refrigerant passage 20 inside the flat tube 2 at the insertion portion 23. Further, at least one of the two regions 41 and 42 of the header 11 is provided with a refrigerant inlet 3 (see FIG. 2) as a first refrigerant inlet connected to the flow passage 21.

Figure 10:
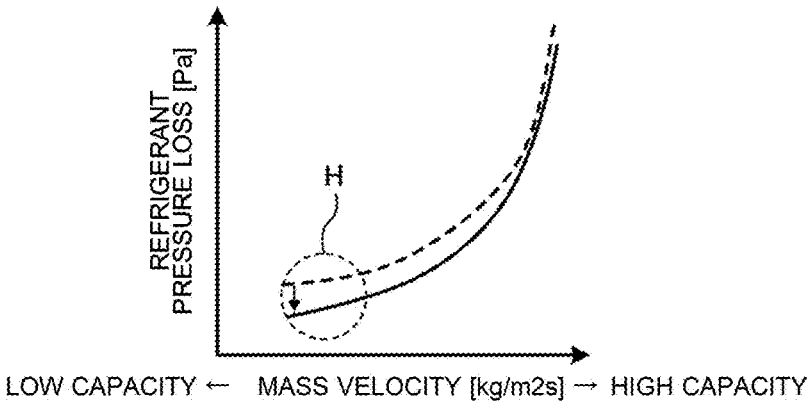
FIG. 10 is a conceptual diagram showing a pressure loss reducing effect of the header according to Embodiment 1.
Figure 11:
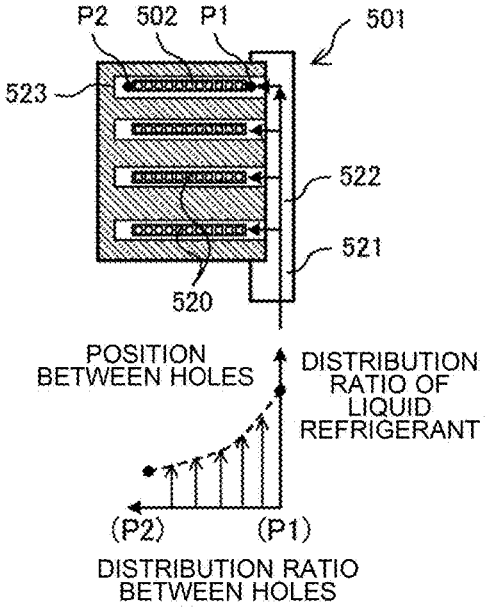
FIG. 11 is a schematic view showing a distribution between holes in a flat tube of the header of the heat exchanger of Comparative Example.
Figure 12:
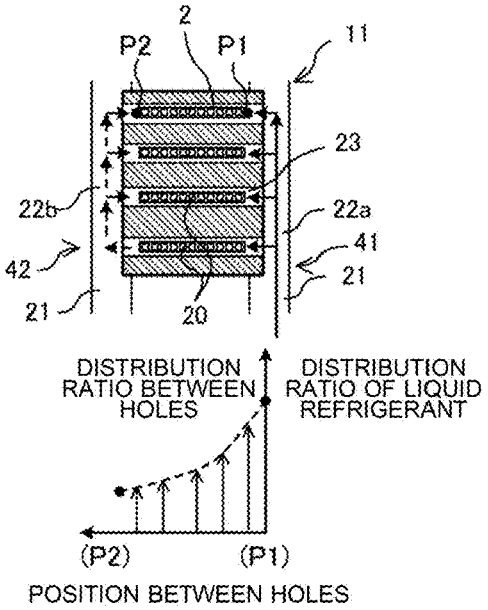
FIG. 12 is a schematic view showing a distribution between holes in the flat tube 2 of the header according to Embodiment 1.
Figure 13:
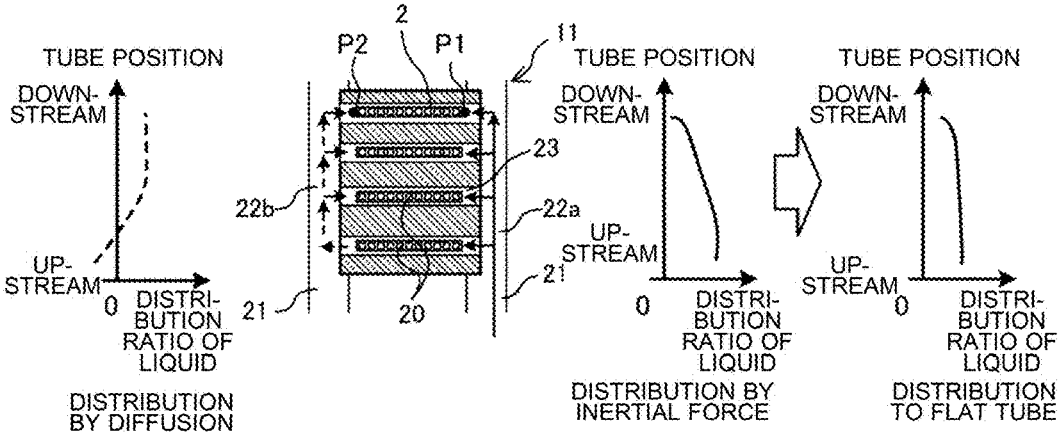
FIG. 13 is a diagram for explaining the flow of the refrigerant in the header according to Embodiment 1.
Figure 14:
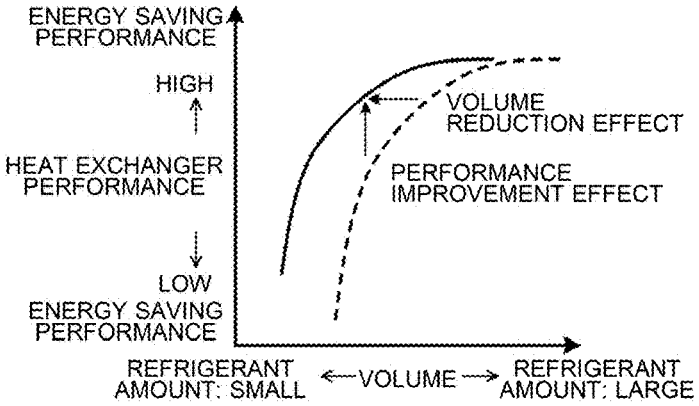
FIG. 14 is a graph showing conceptually a performance improving effect and a refrigerant amount reducing effect of the heat exchanger according to Embodiment 1.
Figure 15:
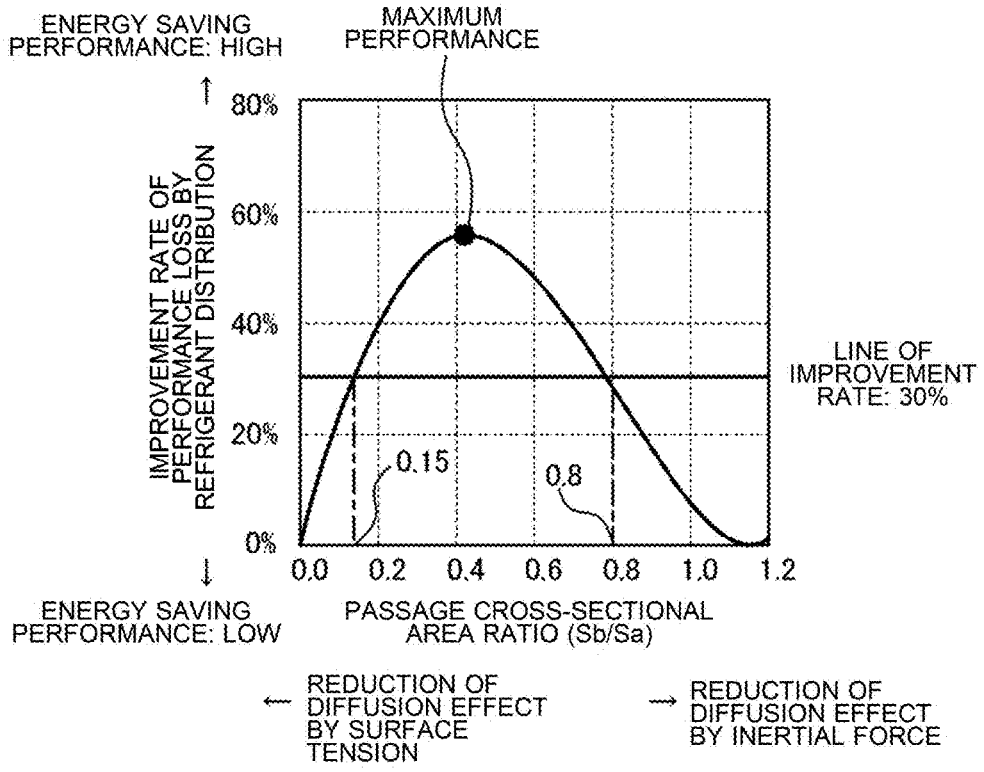
FIG. 15 is a graph showing an improvement rate of performance loss by refrigerant distribution against a passage cross-sectional area of the heat exchanger according to Embodiment 1.

Next, a flow of the refrigerant in the header 11 will be described in comparison with a Comparative Example. FIG. 8 is a perspective view schematically showing a cross-section of the header 501 for explaining a flow of refrigerant in the heat exchanger of Comparative Example. FIG. 9 is a perspective view, partially in cross-section, of the header 11 of the heat exchanger 10 in FIG. 1 for explaining a flow of the refrigerant of the header 11 according to Embodiment 1. FIG. 10 is a conceptual diagram showing a pressure loss reducing effect of the header 11 according to Embodiment 1. FIG. 11 is a schematic view showing a distribution between holes in a flat tube 502 of the header 501 of the heat exchanger of Comparative Example. FIG. 12 is a schematic view showing a distribution between holes in the flat tube 2 of the header 11 according to Embodiment 1. FIG. 13 is a diagram for explaining the flow of the refrigerant in the header 11 according to Embodiment 1. FIG. 14 is a graph showing conceptually a performance improving effect and a refrigerant amount reducing effect of the heat exchanger 10 according to Embodiment 1. FIG. 15 is a graph showing an improvement rate of performance loss by refrigerant distribution against a passage cross-sectional area of the heat exchanger according to Embodiment 1.

Generally, in the header, the flat tube 2 protrudes into the flow passage 21 inside the header 11 for a purpose of securing a connection strength between the flat tube 2 and the header 11, and preventing deterioration in quality due to a flow of brazing material used for connection into the refrigerant passage 20 inside the flat tube 2.

As shown in FIG. 8, in the header 501 of Comparative Example, a contraction area CA and a broad area BA of a flow passage 521 are formed around an insertion portion 523 of each flat tube 502 in the flow passage 521. Therefore, in the header 501 of Comparative Example, since the refrigerant flows in the flow passage 521 with repeating contraction and expansion, a refrigerant pressure loss due to the expansion and contraction of the flow which indicates a positive correlation with a mass velocity of the refrigerant has occurred. In particular, when n is the number of the flat tubes 502 connected to an upstream side of the header 501, and Gm [$kg/m^2s$] is an average flow rate of the refrigerant flowing through the flat tube 502, a flow rate of the refrigerant flowing through the insertion portion 523 of the n flat tubes 502 is n×Gm [$kg/m^2s$]. Then, the refrigerant flows through the broad area BA and the contraction area CA of the flow passage 521 in n times from the flat tube 502 connected to the upstream side of the header 501 to the flat tube 502 connected to a downstream side of the header 501. This results in an increase in the refrigerant pressure loss and a decrease in the heat exchanger performance.

On the other hand, in the heat exchanger 10 according Embodiment 1, the partition portions 7 are provided at the flow passage 21 in the header 11, and the communication passages 22*a* and 22*b* for allowing the insertion portions 23 of the flat tubes 2 to communicate with each other are provided in the flow passage 21 in each of the two regions 41 and 42 of the header 11. Thus, the refrigerant in the two-phase gas-liquid state flows through the communication passages 22*a* and 22*b* as shown in FIG. 9. The communication passage 22*a* and 22*b* are provided at both sides of the third direction X across the center plane 100, and the insertion portions 23 function as a flow passage through which the refrigerant flows in the third direction X by the partition portions 7. The refrigerant flows in the third direction X along the long-side direction of the end portion of the flat tube 2 in the insertion portion 23. As shown in FIG. 9, a typical insertion portion 23 has an elongated shape in which a length of the second direction Z is smaller than a width of the third direction X. Further, the insertion portion 23 is formed so that a distance from the end portion of the flat tube 2 is made to be constant, and the communication passages 22*a* and 22*b* is formed to have a constant passage cross-sectional area in the second direction Z. The refrigerant flowing through the communication passages 22*a* and 22*b* is distributed to the insertion portion 23 sequentially, and then flows into each flat tube 2. This structure is less affected by expansion and contraction due to insertion of the end portion of the flat tube 2 which occurs in the structure of Comparative Example shown in FIG. 8.

Further, since the passage cross-sectional area of the communication passage 22*b* is smaller than that of the communication passage 22*a*, the refrigerant amount is reduced, and a flow rate of the refrigerant to the communication passage 22*a* from the upstream side to the downstream side is also reduced. Therefore gas-liquid exchange is performed to equalize a gas-liquid ratio of the refrigerant between the different insert portions 23. This reduces an excess supply of liquid refrigerant to downstream due to inertia forces and achieves both refrigerant amount reduction and heat exchanger performance.

In the header 11 of Embodiment 1, as compared with the header 501 of Comparative Example in which the refrigerant flows repeatedly the contraction area CA and the broad area BA formed around the insertion portion 523 of the flow passage 521, the refrigerant flow rate can be reduced to about 1/n. Further, since the number of times that the refrigerant flows the insertion portion 23 until reaching the flat tube 2 is suppressed to about 1 to 2 times, it is possible to reduce the pressure loss due to the expansion and contraction of the flow. Therefore, in the heat exchanger 10 including the header 11 of Embodiment 1, an increase of the pressure loss caused by reducing a diameter of the flow passage 21 can be suppressed, and it is possible to achieve both reduction of the refrigerant amount reduction and improvement of the heat exchanger performance.

In FIG. 10, a broken line shows a distribution efficiency of the refrigerant in the header 501 of Comparative Example, and a solid line shows a distribution efficiency of refrigerant in the header 11 of Embodiment 1. As shown in FIG. 10, in particular, when focusing on a ratio of a pressure loss due to the expansion and contraction of the aforementioned flow to the pressure loss in the flow passage 21 of the header 11, the ratio is larger at a low capacity operation when a mass velocity of the refrigerant is lower than at a high capacity operation when the mass velocity of the refrigerant is high. Here, a circle H of a broken line indicates that, in a reduction effect of pressure loss of refrigerant at the header 501 and the header 11, the lower the mass velocity, the greater the reduction effect. This has been shown in tests by the inventors, and the performance improvement effect is particularly significant in the low capacity operation of the air-conditioning apparatus, which dominates a period efficiency. In addition, the refrigerant with lower gas density such as olefin-based refrigerant, propane or DME (dimethyl ether) compared to R32 refrigerant or R410A refrigerant has a higher refrigerant flow velocity per capacity, and thus has a greater performance improvement effect by reducing pressure loss. As the olefin-based refrigerant, HFO1234yf or HFO1234ze(E), etc. may be used.

Next, with reference to FIGS. 11 and 12, distribution of refrigerant in the refrigerant passage 520 of the flat tube 502 in the header 501 of Comparative Example and in the refrigerant passage 20 of the flat tube 2 in the header 11 of Embodiment 1 will be described. In general, in order to ensure pressure resistance strength, the flat tube 502 and the flat tube 2 have a multi-hole tube structure inside in which a plurality of refrigerant passages 520 and 20 are formed with partitions.

As shown in FIG. 11, in the header 501 of Comparative Example, the flow passage 521 is provided only at one end in the long-side direction of the end portion of each flat tube 502, that is, in the third direction X, and the flow passage 521 is provided with a communication passage 522 for allowing the insertion portions 523 of each flat tube 502 to communicate with each other. The refrigerant flows from the end portion at one end of the insertion portion 523 which communicates with the communication passage 522, and is sequentially distributed to each refrigerant passage 520. Therefore, uneven distribution occurs between the refrigerant passages 520, and a heat transfer performance is deteriorated.

In contrast, in the header 11 of Embodiment 1, the flow passage 21 is provided at both end portions of each flat tube 2 in the third direction X, and the flow passage 21 includes the communication passages 22*a* and 22*b* as shown in FIG. 12. That is, in the header 11, the two different regions 41 and 42 in the cross-section of the flat tube 2 divided by the center plane 100 has the communication passages 22*a* and 22*b* to the insertion portion 23 of the flat tube 2, respectively. Therefore, occurrence of uneven distribution between the refrigerant passages 20 is reduced and the heat exchanger performance is improved.

Further, since at least one of the communication passages 22*a* and 22*b* for allowing the insertion portions 23 to communicate with each other is provided at the flow passage 21 of each of the two different regions 41 and 42 of the flat tube 2 divided by the center plane 100, the refrigerant flows from the communication passage 22*a* in one region 41 into the insertion portion 23. Then, the refrigerant is branched into a main flow flowing to the flat tube 2 in the insertion portion 23 and a side flow flowing to the communication passage 22*b* in the other region 42. Since the passage cross-sectional area of the communication passage 22*b* is smaller than that of the communication passage 22*a*, a flow velocity of the refrigerant flowing through the communication passage 22*b* in the other region 42 in the first direction is lower and a refrigerant transport effect due to inertial force is relatively small against the communication passage 22*a*. Therefore, an effect of diffusion caused by a gas-liquid concentration gradient of the flow passage 21 increases.

As shown in FIG. 13, diffusion occurs between the adjacent insertion portions 23 in the adjacent flat tubes 2 and exchange of gas refrigerant or liquid refrigerant occurs to make the gas-liquid concentration gradient be gentle. Therefore, in the header 11 of Embodiment 1, the uneven distribution of the flow which controls a two-phase gas-liquid ratio (hereinafter referred to as distribution) of the refrigerant that flows in the flat tube 502 of the header 501 in Comparative Example shown in FIG. 12 can be reduced and the heat exchanger performance can be improved. Thus, an energy efficiency of the air-conditioning apparatus 200 equipped with the heat exchanger 10 can be improved.

In FIG. 14, a broken line shows a heat exchanger performance of the heat exchanger 10 including the header 501 of Comparative Example, and a solid line shows a heat exchanger performance of the heat exchanger 10 with the header 11 of Embodiment 1. As shown in FIG. 14, in the heat exchanger 10 of Embodiment 1, a sensitivity of a heat exchanger performance to an inner volume of tube is smaller than that in the heat exchanger including the header 501 of Comparative Example, and it is possible to maintain the heat exchanger performance at a lower volume. Thus, it indicates that both refrigerant amount reduction and performance improvement can be achieved.

In FIG. 15, a horizontal axis is an area ratio of the passage cross-sectional area Sa of the communication passage 22*b* to the passage cross-sectional area Sb of the communication passage 22*b*. The value 0 indicates the header 501 without the communication passage 22*b*, and the value 1 indicates that the passage cross-sectional area of the communication passage 22*a* is equal to that of the communication passage 22*b*. Further, a vertical axis shows an improvement rate of performance loss by refrigerant distribution, where a reduction rate of a heat exchanger performance of the heat exchanger 10 including the header 501 of Comparative Example to a heat exchanger performance of the heat exchanger 10 in uniform distribution may be achieved is 100%. The disclosers have confirmed through this evaluation test that reducing the passage cross-sectional area ratio Sb/Sa to less than 1 improves the distribution of refrigerant and reduces heat exchanger performance loss by up to 50% or more. When the passage cross-sectional area ratio Sb/Sa is significantly reduced, a wetting length becomes relatively large against the passage cross-sectional area of the communication passage 22*b*, a distribution improving effect due to diffusion is disturbed by surface tension of liquid film on a wall surface, and performance is reduced. On the other hand, when the passage cross-sectional area ratio Sb/Sa is increased and becomes 1, the inertial force increases due to increase of a flow rate of the refrigerant flowing through the communication passage 22*b*, a distribution improving effect due to diffusion is disturbed, and performance is reduced. In particular, by making the passage cross-sectional area Sb/Sa larger than 0.15 and smaller than 0.8, the heat exchanger performance loss is reduced by up to 30% or more and a significant effect can be achieved.

Effect of Embodiment 1

As described above, in the heat exchanger 10 and the air-conditioning apparatus 200 equipped with the heat exchanger 10, the header 11 includes the partition portion 7 which blocks at least a part of the flow passage 21 between the adjacent flat tubes 2. Additionally, the communication passages 22*a* and 22*b* are provided between the insertion portions 23 of the flat tubes 2. The insertion portions 23 are formed by being sandwiched between the adjacent partition portions 7 so as to communicate the insertion portions 23 with each other. In this case, the communication passage 22*a* in the flow passage 21 of the header 11 is formed without via the insertion portion 23 into which the flat tube 2 is inserted. According to this configuration, the refrigerant pressure loss due to the expansion and contraction of the refrigerant flow that occurs in the insertion portion 23 is reduced, and increase of the pressure loss caused by reducing the diameter of the flow passage 21 can be suppressed.

In addition, when the header 11 is divided into the two different regions 41 and 42 by the center plane 100 passing through the center of the flat tube 2 in the third direction X, the two regions 41 and 42 is provided with the communication passages 22*a* and 22*b*, respectively. At least one region 41 of the two regions 41 and 42, the refrigerant inlet 3 which is connected to the flow passage 21 is provided. By providing the refrigerant inlet 3 in the communication passage 22*a*, the header 11 has a configuration in which the communication passage 22*a* for transporting the refrigerant mainly by inertia force from the refrigerant inlet 3 to the insertion portion 23 of the flat tube 2, and the communication passage 22*b* for exchanging the gas-liquid mainly by diffusion through the insertion portion 23 of the flat tube 2 are provided. According to this configuration, uneven distribution of the refrigerant due to changes in refrigerant flow velocity is reduced, and the heat exchanger performance is improved, thereby improving the energy efficiency of the air-conditioning apparatus 200 equipped with the heat exchanger 10. Thus, by reducing the refrigerant pressure loss and achieving uniform distribution of the refrigerant, the heat exchanger performance can be improved. Further, at least in a connection portion between the insertion portion 23 and the communication passage 22*b*, the width of the insertion portion 23 in the second direction is smaller than the width of the solid partition portion 7 in the second direction. According to this configuration, an effect of the inertia force of the refrigerant flow in the communication passage 22*a* on the flow in the communication passage 22*b* is reduced, and the heat exchanger performance is improved. Further, since the partition portion 7 is wide and solid, it is possible to save refrigerant and this is particularly effective.

In FIGS. 1 to 3, the header 11 is provided at a top and a bottom of the heat exchanger 10 in a gravity direction. However, the arrangement of the header 11 is not limited thereto. The header 11 may be provided at only one of the top and the bottom of the heat exchanger 10 in the gravity direction. Further, when the flat tubes 2 extend toward the second direction Z instead of the first direction Y, and arranged to be spaced apart from each other in the first direction Y, the header 11 may be provided at at least one of the left side and right side of the heat exchanger 10 perpendicular to the gravity direction. However, it is more effective to place the header 11 on the top or the bottom in the gravity direction, since the inhibition of diffusion due to the difference in gas-liquid density can be reduced. Further, in FIG. 1, the air-conditioning apparatus 200 includes the heat exchanger 10 in the outdoor unit 201. However, the heat exchanger 10 can be installed in the indoor unit 202, and the effect is not hindered in this case. Further, the header 11 may have a region where the partition portion 7 is not provided at the upstream side or the downstream side of the header 11.

Figure 16:
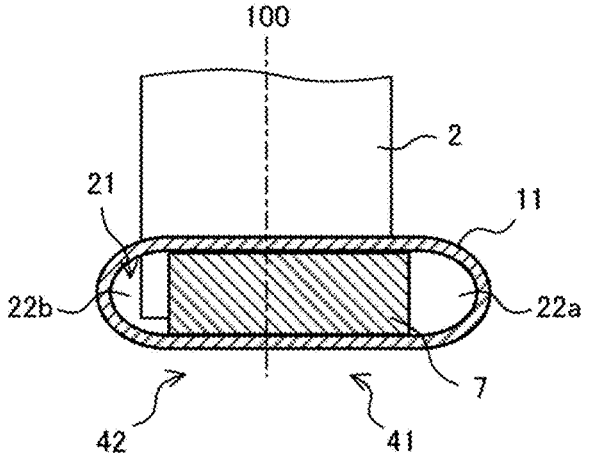
FIG. 16 is a schematic cross-sectional view showing a modification of the header according to Embodiment 1.

FIG. 16 is a schematic cross-sectional view showing a modification of the header 11 according to Embodiment 1. As shown in FIG. 16, as a configuration of the header 11, for example, a part of the adjacent flat tubes 2 may not be partitioned by the partition portion 7. In particular, by reducing the partition portion 7 of the communication passage 22 at a region where diffusion occurs, it is possible to reduce contribution of the inertial force to the distribution.

Figure 17:
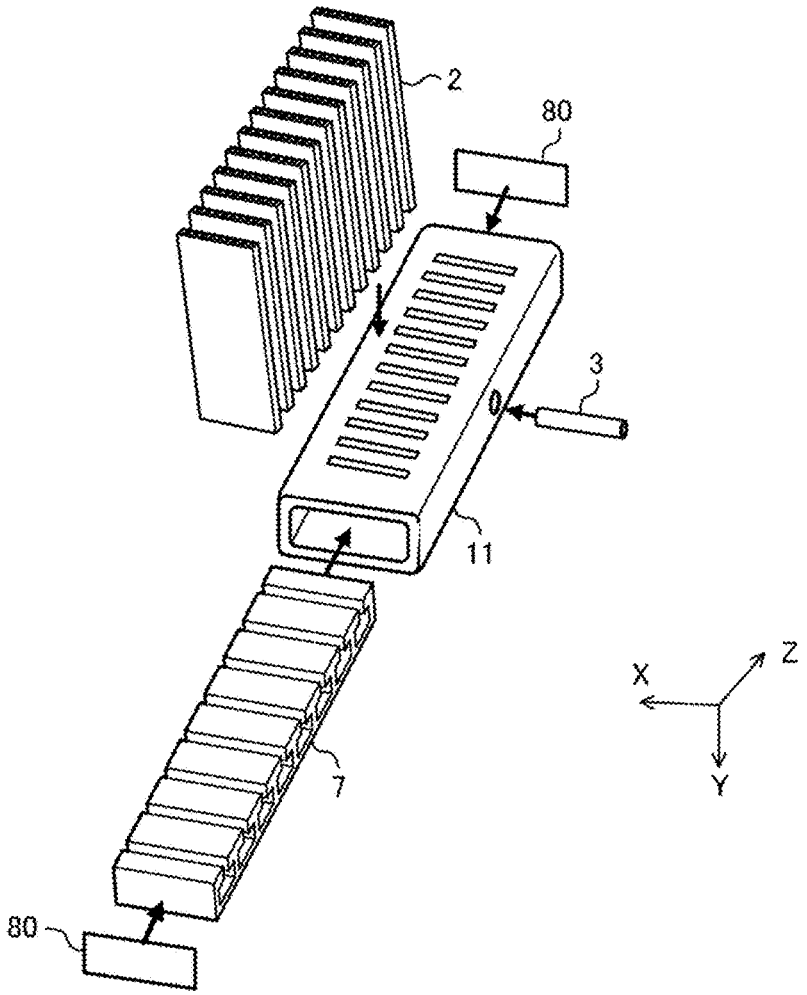
FIG. 17 is an exploded perspective view showing an example of the header according to Embodiment 1.
Figure 18:
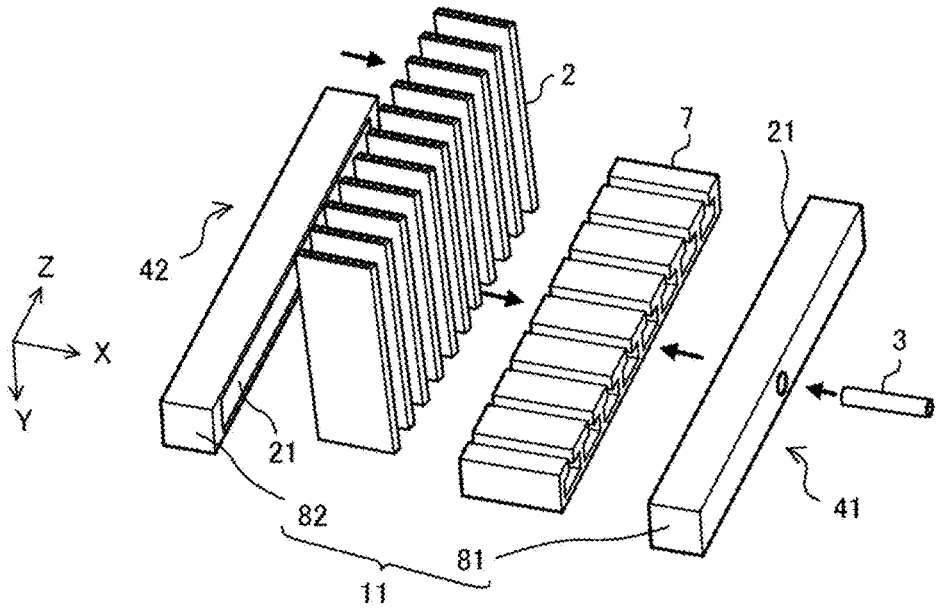
FIG. 18 is an exploded perspective view showing a modification of the header according to Embodiment 1.
Figure 19:
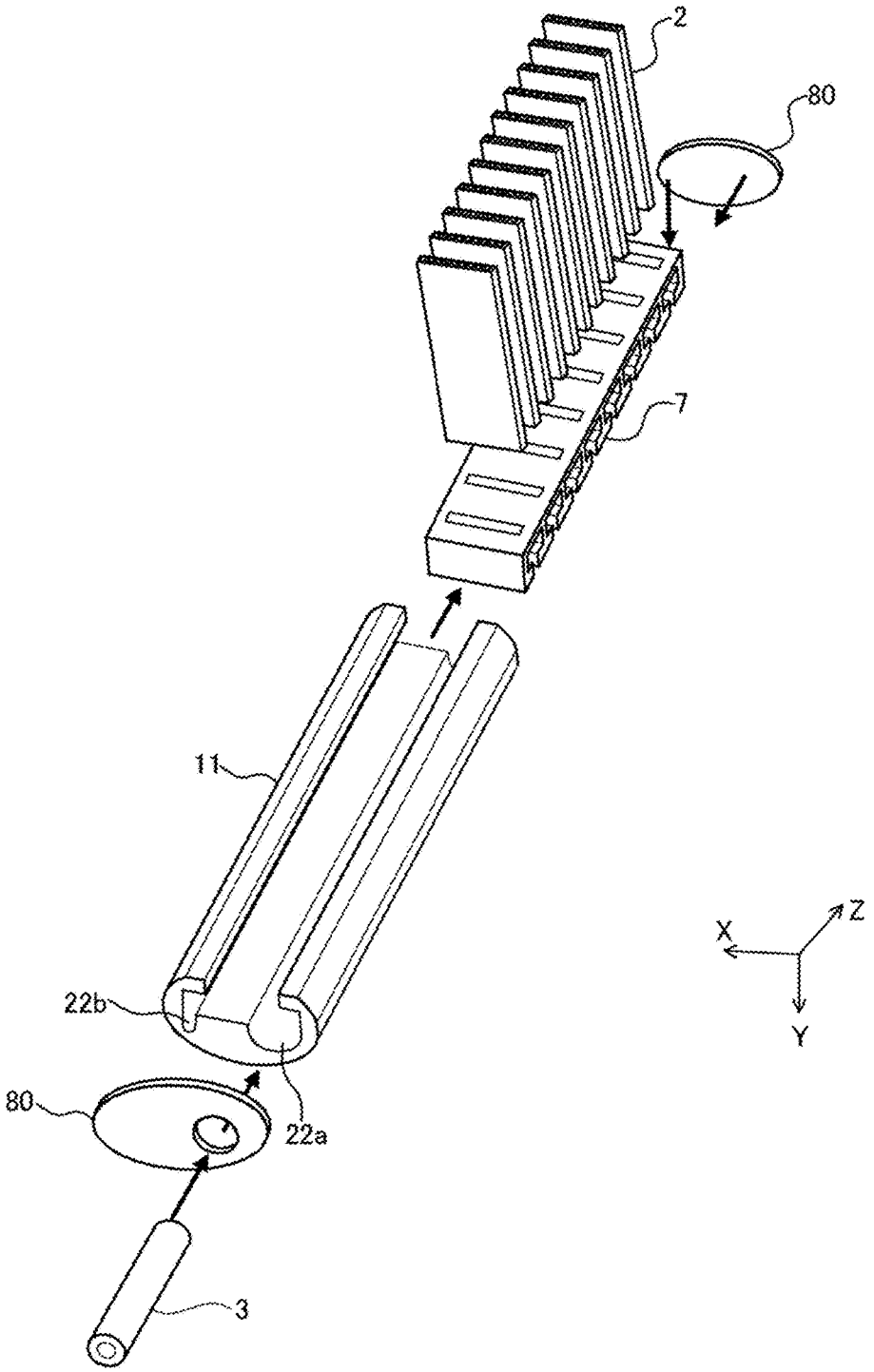
FIG. 19 is an exploded perspective view showing a modification of the header according to Embodiment 1.
Figure 20:
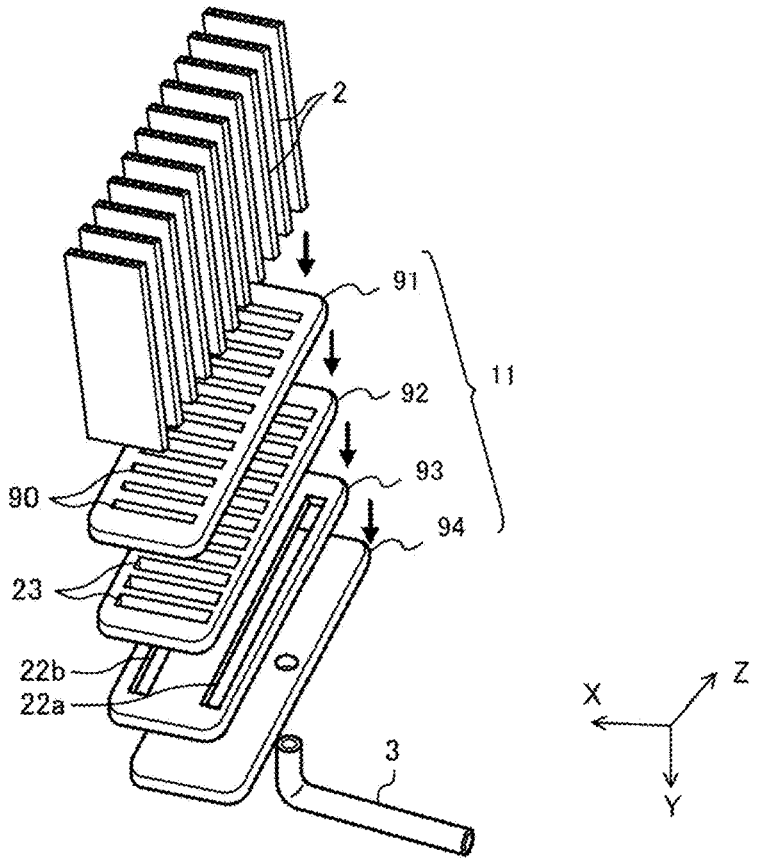
FIG. 20 is an exploded perspective view showing a modification of the header according to Embodiment 1.

Here, a detailed configuration example of the header 11 will be described. FIG. 17 is an exploded perspective view showing an example of the header 11 according to Embodiment 1. FIG. 18 is an exploded perspective view showing a modification of the header 11 according to Embodiment 1. FIG. 19 is an exploded perspective view showing a modification of the header 11 according to Embodiment 1. FIG. 20 is an exploded perspective view showing a modification of the header 11 according to Embodiment 1. FIGS. 17 to 20 show examples of a component configuration of the header 11.

As shown in FIG. 17, in the header 11 of Embodiment 1, it is preferable that the plurality of flat tubes 2, the tubular refrigerant inlet 3, and the partition portions 7 are assembled to a rectangular box-shaped header 11, and an opening formed at both ends of the header 11 in the second direction Z is closed by a cover 80. In this case, it is preferable that the components are joined by, for example, brazing.

As in a modification shown in FIG. 18, the header 11 may be constructed by rectangular box-shaped covers 81 and 82 which are open to face each other. In this case, the covers 81 and 82 are formed with the flow passage 21 in which the above-described communication passages 22*a* and 22*b* (not shown here for simplicity) are provided, respectively. Then, the plurality of flat tubes 2 are assembled to the partition portion 7 in a state of being arranged in the second direction Z which is the thickness direction thereof, and the covers 81 and 82 are assembled so as to cover both ends of the partition portion 7 to which the flat tubes 2 are assembled in the third direction X which is the width direction of the flat tubes 2. With such a configuration, the position of the flat tube 2 can be easily adjusted as compared with a case where the flat tube 2 is inserted and assembled to the partition portion 7 in the first direction Y. Thus, an occurrence of blocking or collapsing of the flow passage 21 due to poor positioning can be suppressed.

Further, as in a modification shown in FIG. 19, the header 11 may be configured by a member 82 formed by extrusion molding in the second direction Z and covers 80 that closes both ends of the member 82 in the second direction Z. In this case, the communication passages 22*a* and 22*b* are formed in a space surrounded by the extrusion member and the partition member. The covers 80 cover both ends of the extrusion member 82 in the second direction Z. The refrigerant inlet 3 is assembled at one end which closes the communication passage 22*a*. With such a configuration, in addition to the effect of the modification shown in FIG. 18, it is easy to adjust the passage cross-sectional area of the communication passages 22*a* and 22*b*.

Further, as shown in the modification of FIG. 20, the header 11 may be formed by stacking a plurality of plate-shaped members 91 to 94. In this case, the plate-shaped member 91 has penetrating portions 90 that penetrate the plate-shaped member 91 and hold the plurality of flat tubes 2, and functions as a cover portion. Further, the plate-shaped member 92 is provided with a plurality of insertion portions 23. The number of the insertion portions 23 corresponds to the number of the flat tubes 2. Incidentally, a size of the penetrating portion 90 is the same as an outer periphery of the flat tube 2 and smaller than the insertion portion 23. Therefore, the penetrating portion 90 closes an upper surface side of the insertion portion 23 in a state where the flat tube 2 is assembled. The plate-shaped member 93 has the communication passages 22*a* and 22*b* formed at both end side portions in the third direction X. The plate-shaped member 94 is connected to the tubular refrigerant inlet 3, and constitutes a bottom of the header 11. The plate-shaped members 91 to 94 are stacked and assembled in the first direction Y of the flat tube 2 to form the header 11.

Figure 21:
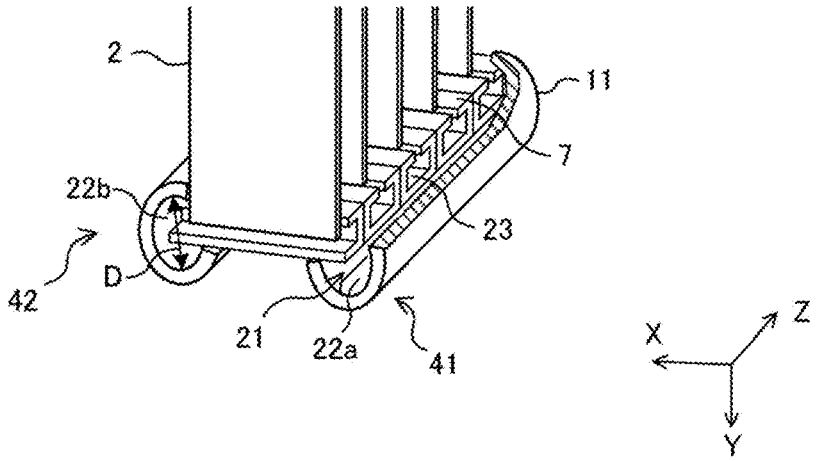
FIG. 21 is a cross-sectional perspective view showing a modification of the header according to Embodiment 1.

FIG. 21 is a cross-sectional perspective view showing a modification of the header 11 according to Embodiment 1. As shown in FIG. 21, the communication passages 22*a* and 22*b* of the header 11 according to Embodiment 1 may be placed below the insertion portion 23, as long as the communication passages 22*a* and 22*b* are provided in each of the two regions 41 and 42 divided by the center plane 100 of the flat tube 2. With such a configuration, a passage diameter of each of the communication passages 22*a* and 22*b* can be designed without increasing the size of the header 11 in the air flow direction AF of the heat exchanger 10 (i.e., the third direction X of the header 11, see FIG. 2). Therefore, it is possible to reduce a space in a case where another heat exchanger 10 is provided so that different heat exchangers are arranged at the upstream side and the downstream side of the air flow direction AF of the heat exchanger 10 by arranging different flat tubes in parallel in the third direction X of the flat tube 2, or when the heat exchanger 10 is installed in a product housing.

Figure 22:
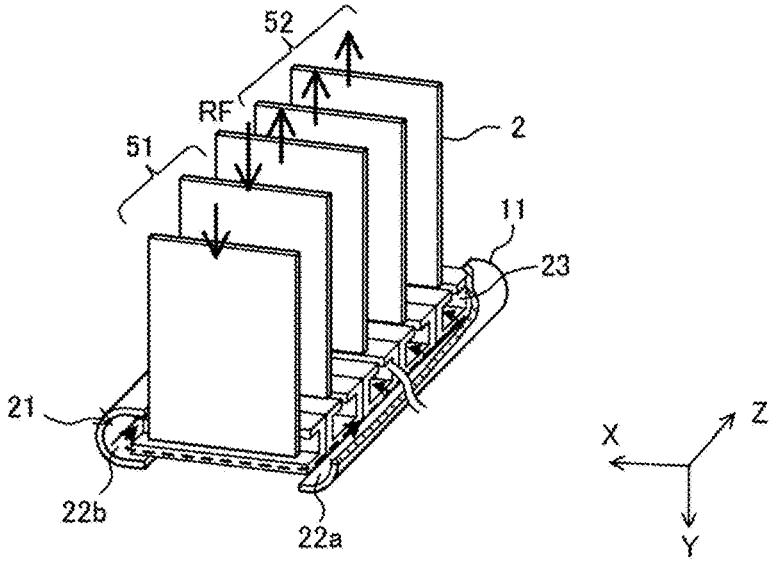
FIG. 22 is a perspective view, partially in cross-section, of the header for explaining a flow of the refrigerant of the header according to a modification of Embodiment 1.

FIG. 22 is a perspective view of, partially in cross-section, the header 11 for explaining a flow of the refrigerant of the header 11 according to a modification of Embodiment 1. As shown in FIG. 22, in the header 11, the plurality of flat tubes 2 may be divided into a first heat transfer tube group 51 provided at an upstream side of the flow passage 21 and a second heat transfer tube group 52 provided at a downstream side of the flow passage 21 such that a heat transfer portion is provided at the upstream side and the downstream side of the header 11. In this case, by reducing the pressure loss of the flow passage 21 in the header 11, a difference of a condensation temperature (or evaporation temperature) of the refrigerant between the upstream side of the heat transfer portion and the downstream side of the heat transfer portion is reduced. Thus, there is an advantage of increasing the heat exchanger performance improvement effect.

Embodiment 2

Figure 23:
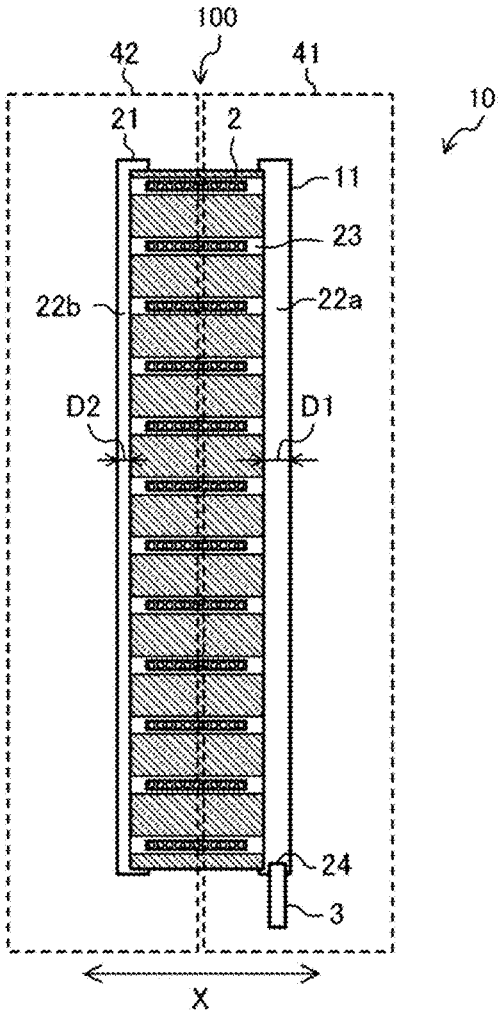
FIG. 23 is a schematic view showing a horizontal cross-section of the header in the heat exchanger according to Embodiment 2.
Figure 24:
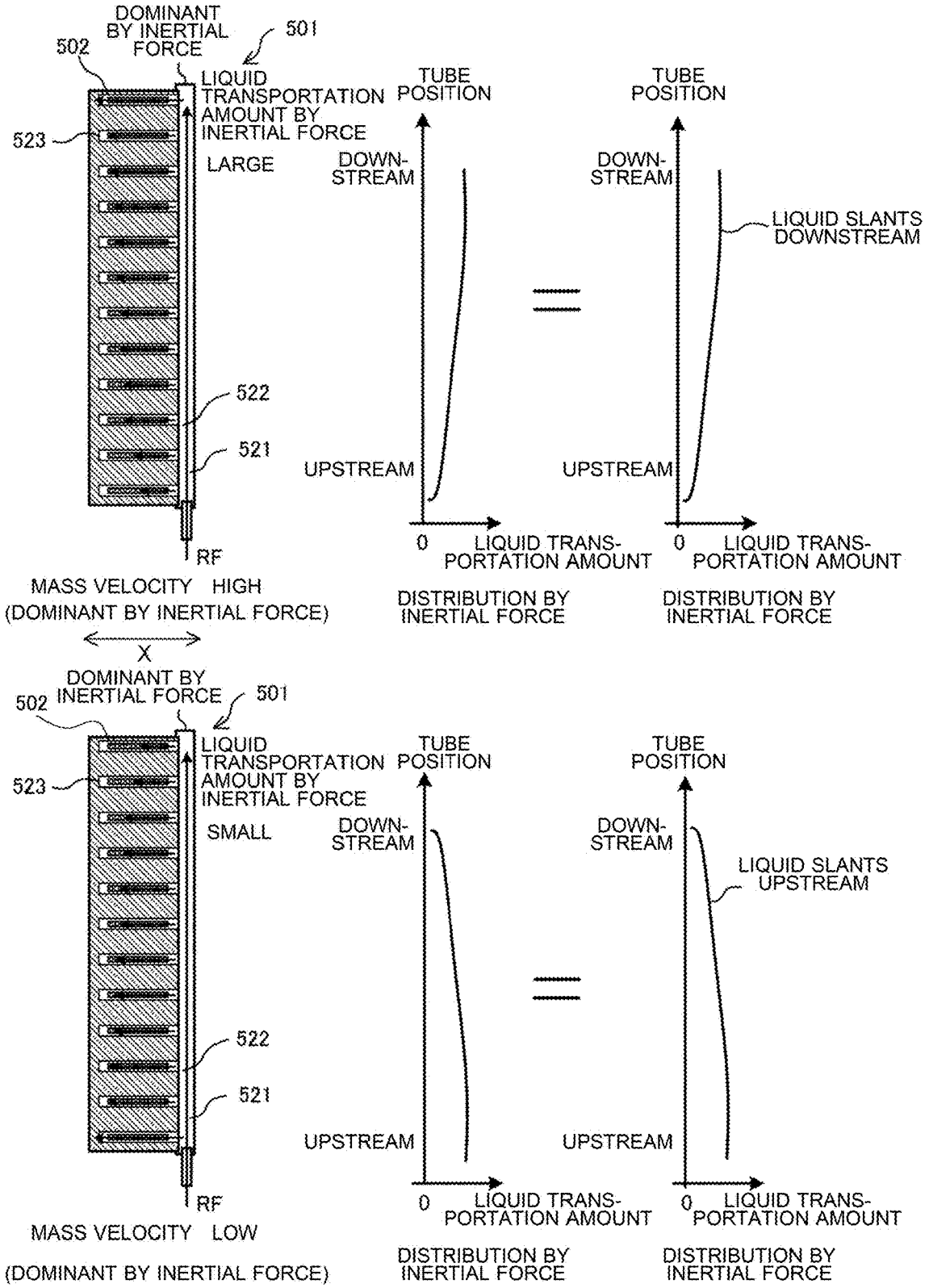
FIG. 24 is a schematic view for explaining a distribution performance of a header in a heat exchanger according to Comparative Example.
Figure 25:
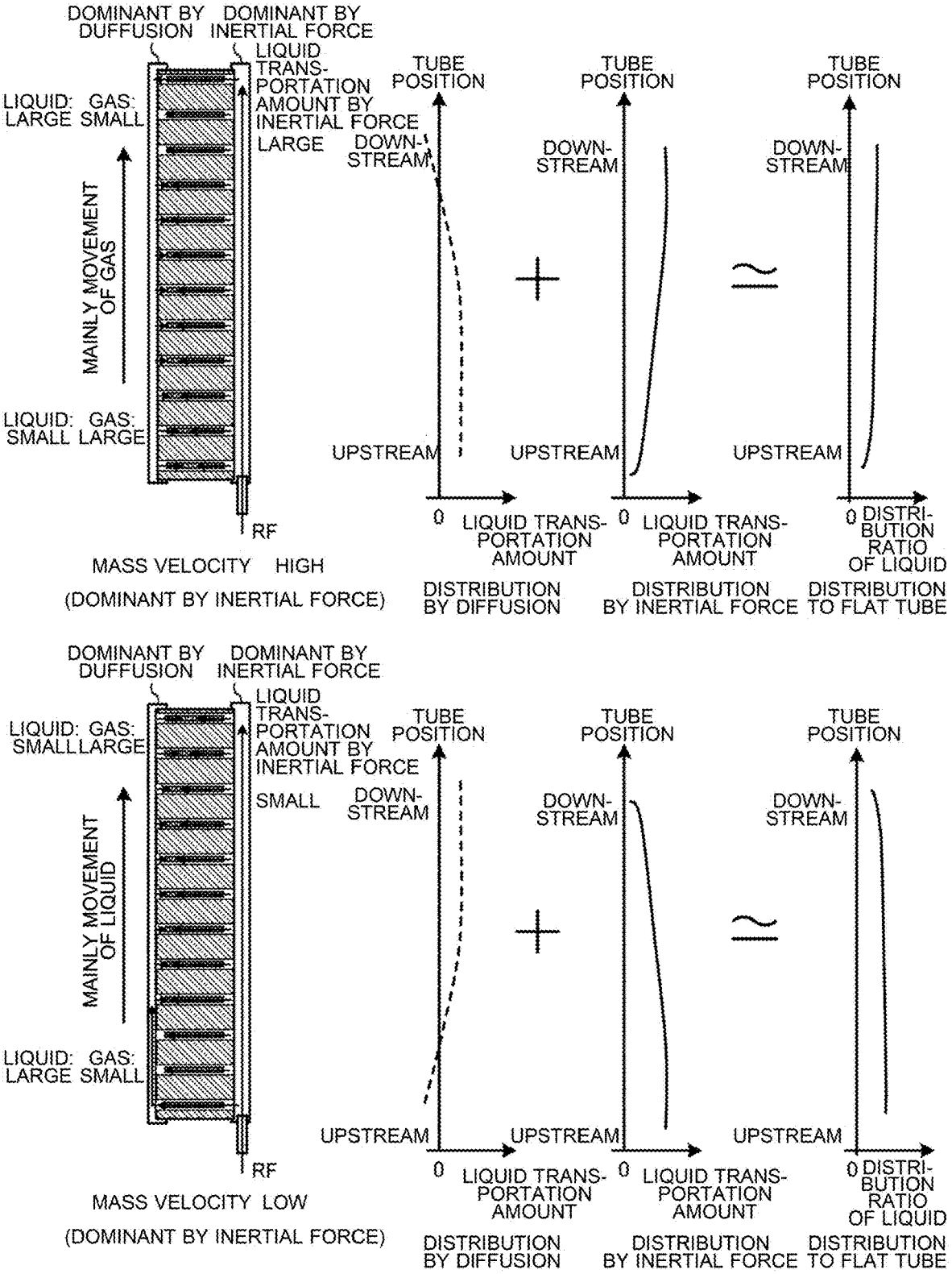
FIG. 25 is a schematic view for explaining a distribution performance of the header in the heat exchanger according to Embodiment 2.
Figure 26:
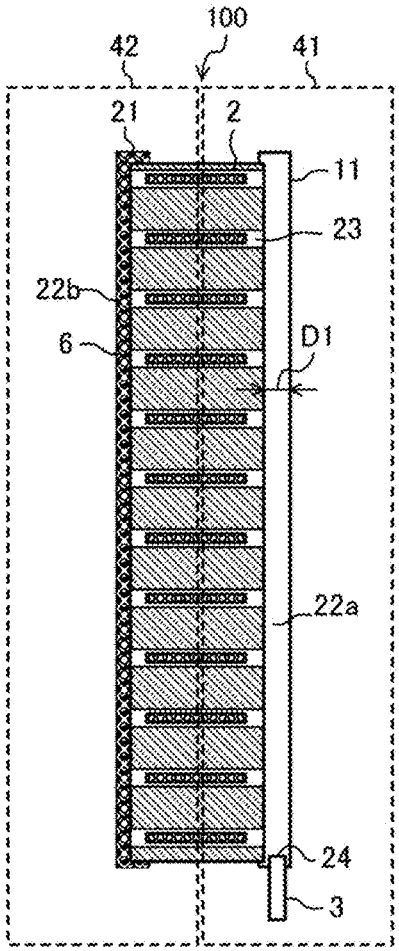
FIG. 26 is a schematic view showing a cross-section of the header in an X-Z plan of a modification of the heat exchanger according to Embodiment 2.

Next, a heat exchanger 10 and an air-conditioning apparatus 200 equipped with the heat exchanger 10 according to Embodiment 2 will be described. FIG. 23 is a schematic view showing a horizontal cross-section of the header 11 in the heat exchanger 10 according to Embodiment 2. FIG. 24 is a schematic view for explaining a distribution performance of a header 501 in a heat exchanger according to Comparative Example, FIG. 25 is a schematic view for explaining a distribution performance of the header 11 in the heat exchanger 10 according to Embodiment 2. FIG. 26 is a schematic view showing a cross-section of the header 11 in an X-Z plane of a modification of the heat exchanger 10 according to Embodiment 2. For convenience purpose and visibility, a reference sign of each part of the header 11 is omitted in FIG. 25. The header 11 in FIG. 25 is the same as and correspond to that in FIG. 23.

In Embodiment 2, the header 11 is partially modified from the header 11 of Embodiment 1. Since an overall configuration of the heat exchanger 10 and the air-conditioning apparatus 200 of Embodiment 2 is the same as that of Embodiment 1, it is not shown and described in detail here, and similar or corresponding components are denoted by the same reference signs as Embodiment 1. The header 11 of the heat exchanger 10 according to Embodiment 1 basically has a configuration in which two regions are symmetrical across the center plane 100. In contrast, the two regions may be asymmetrical as shown in Embodiment 2.

As shown in FIG. 23, the header 11 of the heat exchanger 10 according to Embodiment 2 includes a refrigerant inlet 24 provided at an eccentric position along the third direction X of the flat tube 2, which is the air flow direction AF of the heat exchanger 10 (see FIG. 2), with the center plane 100 of the header 11 as a border. In accordance with this configuration, a position of a communication passage 22*a* of one region 41 side is eccentric in the third direction X from a position symmetrical to a position of a communication passage 22*b* of the other region 42 side across the center plane 100. In other words, a position where the refrigerant inlet 24 is connected to the communication passage 22*a* of one region 41 side is shifted in the third direction X from a position symmetrical to a position of the communication passage 22*b* of the other region 42 side about the center plane 100. For example, in Embodiment 2, the refrigerant inlet 24 is provided at a position eccentric to one region 41 side of two regions which are different from each other in the third direction X of the header 11. The arrangement of the refrigerant inlet 24 is not limited thereto. The refrigerant inlet 24 may be provided at a position eccentric to the other region 42 side.

As shown in FIG. 24, in a configuration of Comparative Example, a flow passage 521, in which the communication passage 522 is formed, is provided only at one end of the flat tube 502 in the third direction X. Therefore, an amount of liquid transported to the flat tube 502 is dominated by inertial force. Thus, the liquid refrigerant is transported disproportionately more to the flat tubes 502 located in downstream in an operation with a large mass velocity, and is transported disproportionately more to the flat tubes 502 located in upstream in an operation with a low mass velocity. This results in reducing the heat exchanger performance.

In contrast, as shown in FIG. 25, with respect to a distribution characteristic of the refrigerant from the communication passages 22*a* and 22*b* to the insertion portion 23 in the header 11 of the heat exchanger 10 of Embodiment 2, diffusion of the refrigerant by the inertial force is dominant in the communication passage 22*a* in one region 41. Additionally, in the communication passage 22*b* in the other region 42, diffusion due to collision from the insertion portion 23 to the communication passage 22*b* is dominant. In this case, in the operation with the large mass velocity, the inertial force of the refrigerant flowing through the communication passage 22*a* in one region 41 increases, the amount of the liquid refrigerant transported to the insertion portion 23 of the flat tubes 2 in downstream increases, and the amount of refrigerant flowing into the communication passage 22*b* in the other region 42 also increases. On the other hand, in the operation with the low mass velocity, the inertial force of the refrigerant flowing through the communication passage 22*a* in one region 41 decreases, the amount of the liquid refrigerant transported to the insertion portion 23 of the flat tubes 2 in downstream decreases, and the amount of refrigerant transported to the communication passage 22*b* in the other region 42 by diffusion increases. Thus, a sensitivity of refrigerant distribution to mass velocity is reduced, and the performance is improved in a wide capacity range.

Further, as shown in FIG. 23, when the refrigerant inlet 24 is in one region 41 eccentrically from the center plane 100 of the cross-section of the flat tube 2, a passage diameter of the communication passage 22*a* in one region 41 is defined as a hydraulic diameter D1 and a passage diameter of the communication passage 22*b* in the other region 42 is defined as a hydraulic diameter D2. In this case, by making the hydraulic diameter D1 of the communication passage 22*b* in one region 41 larger than the hydraulic diameter D2 of the communication passage 22*b* in the other region 42, a liquid transport effect by diffusion in the communication passage 22*b* in the other region 42 is improved. This results in improvement of the performance (see FIG. 25). For example, as a means for reducing the hydraulic diameter D2, a porous body 6 may be provided in the communication passage 22*b* of the flow passage 21 in the other region 42 as shown in FIG. 26 so that a wetting edge area of a passage (liquid passage) through which the refrigerant passes in the communication passage 22*b* increases.

Effect of Embodiment 2

As described above, in the heat exchanger 10 and the air-conditioning apparatus 200 equipped with the heat exchanger 10 of Embodiment 2, the refrigerant inlet 24 is provided at a position eccentric in the third direction X of the flat tube 2 which is the air flow direction AF of the heat exchanger 10 (see FIG. 2) from the center plane 100 of the header 11. With respect to the distribution characteristic of the refrigerant from the communication passages 22*a* and 22*b* to the insertion portion 23, the inertial force of the refrigerant is dominant in the communication passage 22*a* in one region 41 and diffusion due to collision from the insertion portion 23 to the communication passage 22*b* is dominant in the communication passage 22*b* in the other region 42. Therefore, the sensitivity of refrigerant distribution to mass velocity is reduced, and the performance is improved in a wide capacity range.

Further, when the passage diameter of the communication passage 22*a* in one region 41 is defined as the hydraulic diameter D1 and the passage diameter of the communication passage 22*b* in the other region 42 is defined as the hydraulic diameter D2, the hydraulic diameter D1 is larger than the hydraulic diameter D2. According to this configuration, the liquid transport effect by diffusion in the communication passage 22*b* in the other region 42 is improved, and the heat exchanger performance can be improved.

Embodiment 3

Figure 27:
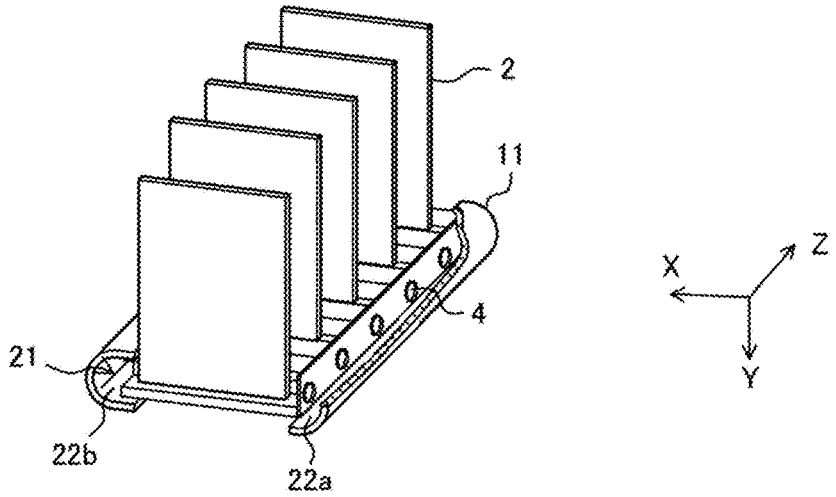
FIG. 27 is a perspective view showing, partially in cross-section, a header of the heat exchanger according to Embodiment 3.
Figure 28:
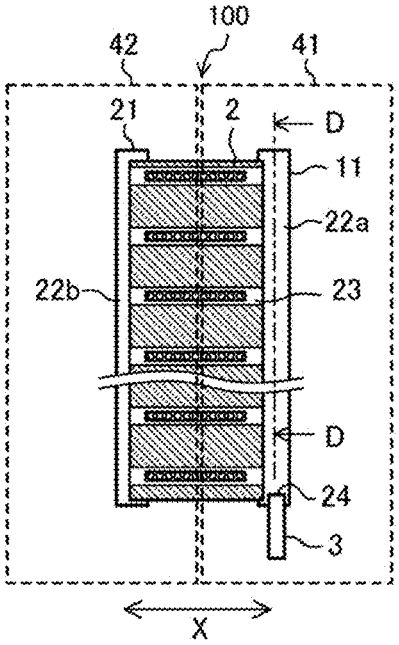
FIG. 28 is a schematic view showing a horizontal cross-section of the header in FIG. 27.
Figure 29:
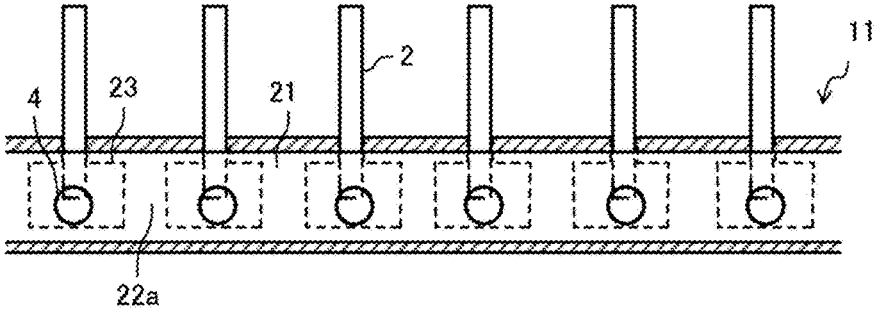
FIG. 29 is a schematic view showing a cross-section of the header in FIG. 28 in a D-D field of view.
Figure 30:
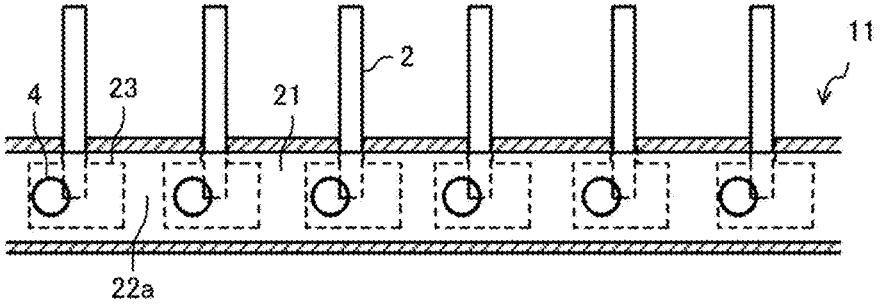
FIG. 30 is a schematic cross-sectional view showing a modification of the header in FIG. 29.

Next, a heat exchanger 10 and an air-conditioning apparatus 200 equipped with the heat exchanger 10 according to Embodiment 3 will be described, FIG. 27 is a perspective view showing, partially in cross-section, a header 11 of the heat exchanger 10 according to Embodiment 3. FIG. 28 is a schematic view showing a horizontal cross-section of the header 11 in FIG. 27. FIG. 29 is a schematic view showing a cross-section of the header 11 in FIG. 28 in a D-D field of view. FIG. 30 is a schematic cross-sectional view showing a modification of the header 11 in FIG. 29.

In Embodiment 3, the header 11 of Embodiment 2 is partially modified, and a configuration of the heat exchanger 10 and the air-conditioning apparatus 200 is the same as that of Embodiment 1. Therefore, description thereof is omitted, and same or corresponding components are denoted by the same reference signs as Embodiment 1.

As shown in FIGS. 27 to 29, the header 11 according to Embodiment 3 includes a refrigerant inlet 24 provided at a position eccentric in the third direction X of the flat tube 2 which is the air flow direction AF of the heat exchanger 10 (see FIG. 2) from the center plane 100 of the header 11 (see FIG. 2). Specifically, the refrigerant inlet 24 is provided, for example, on one region 41 side of the two regions 41 and 42. Further, the header 11 has a contraction hole 4 only in the communication passage 22*a* of the flow passage 21 to which the refrigerant inlet 24 is connected. The contraction hole 4 is provided at a connecting part which connects the communication passage 22*a* and the insertion portions 23 to which the flat tubes 2 are inserted. As shown in FIG. 29, it is preferable that a plurality of contraction holes 4 are provided so that each contraction hole 4 is positioned on the same line as each flat tube 2 with respect to the insertion portions 23 (FIGS. 27 and 28) of the header 11 which extends in the third direction X of the flat tube 2.

Effect of Embodiment 3

As described above, in the header 11 of Embodiment 3, the contraction hole 4 is provided between the communication passage 22*a* in one region 41 which includes the refrigerant inlet 24 and the insertion portion 23 of the flat tube 2. With such a configuration, a sensitivity of two-phase gas-liquid distribution to inertial forces is reduced. In addition, since the contraction hole 4 is not provided in the communication passage 22*b*, a size of the header is not increased, Therefore, a distribution improvement effect by diffusion in the communication passage 22*b* in the other region 42 is improved, and the heat exchanger performance can be improved.

Incidentally, as shown in FIG. 30, each contraction hole 4 may be provided at a position eccentric in the first direction Y in which the flat tubes 2 are arranged in parallel from a position on the same line as the flat tubes 2 with respect to the insertion portion 23 (see FIGS. 25 and 26) which extends in the third direction X of the flat tube 2 in the header 11.

Thus, since the contraction hole 4 is eccentric in the second direction Z with respect to the insertion portion 23, the center of the contraction hole 4 deviates from the central axis of the flat tube 2 generally located near the center of the insertion portion 23. This causes a reduction of collision to the protruding portion of the flow passage 21 of the flat tube 2 in the refrigerant flow from the communication passage 22*a* in one region 41 to the communication passage 22*b* in the other region 42, and a flow rate of the refrigerant in the communication passage 22*b* in the other region 42 is improved. Therefore, due to promotion of agitation, the distribution improvement effect by diffusion and the heat exchanger performance can be improved.

Embodiment 4

Figure 31:
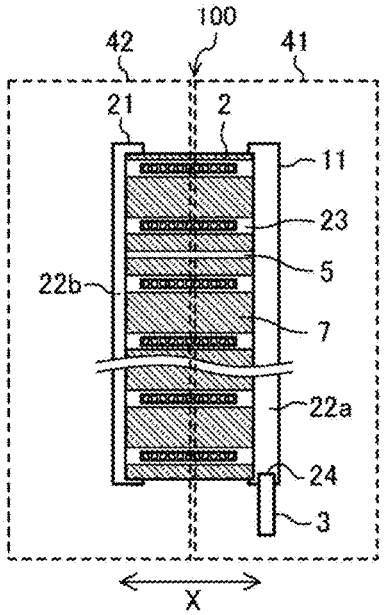
FIG. 31 is a schematic view showing a horizontal cross-section of the header of the heat exchanger according to Embodiment 4.

Next, a heat exchanger 10 and an air-conditioning apparatus 200 equipped with the heat exchanger 10 according to Embodiment 4 will be described. FIG. 31 is a schematic view showing a horizontal cross-section of the header 11 of the heat exchanger 10 according to Embodiment 4. In Embodiment 4, the header 11 of Embodiment 2 is partially modified, and a configuration of the heat exchanger 10 and the air-conditioning apparatus 200 is the same as that of Embodiment 1. Therefore, description thereof is omitted, and same or corresponding components are denoted by the same reference signs as Embodiment 1.

As shown in FIG. 31, in the header 11 of the heat exchanger 10 according to Embodiment 4, a connection passage 5 penetrating the partition portion 7 along the third direction X is provided at at least one of the partition portions 7 located between the adjacent flat tubes 2. The connection passage 5 connects the communication passage 22*a* to the communication passage 22*b* in each of two regions 41 and 42 of the flow passage 21 divided by the center plane 100 of the flat tube 2. The connection passage 5 is parallel to the insertion portion 23. That is, the connection passage 5 is provided along the air flow direction AF (see FIG. 2) of the heat exchanger 10 which is the third direction X of the flat tube 2. No flat tube 2 is inserted into the connection passage 5. At least one connection passage 5 is provided in the header 11.

Effect of Embodiment 4

As described above, in the header 11 of Embodiment 4, the connection passage 5 which connects the communication passage 22*a* and the communication passage 22*b* in the two regions 41 and 42 and to which the flat tube 2 is not inserted is provided. According to this configuration, a flow with a high refrigerant velocity can be created with respect to the insertion portion 23. Thus, by the refrigerant flowing through the connection passage 5, for example, in the header 11 configured eccentrically in one region 41, agitation of the refrigerant in the communication passage 22*b* in the other region 42 is promoted, and the distribution improving effect and the heat exchanger performance can be improved.

Embodiment 5

Figure 32:
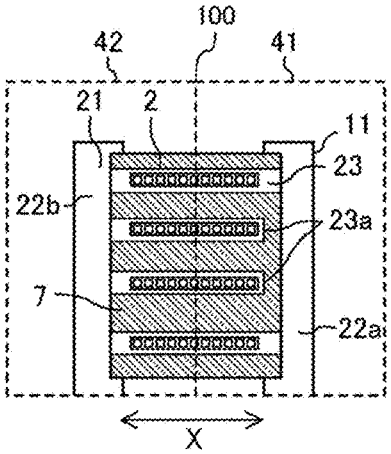
FIG. 32 is a schematic view showing a horizontal cross-section of the header of the heat exchanger according to Embodiment 5.

Next, a heat exchanger 10 according to Embodiment 5 will be described. FIG. 32 is a schematic view showing a horizontal cross-section of the header 11 of the heat exchanger 10 according to Embodiment 5. In Embodiment 5, the header 11 of Embodiment 1 is partially modified, and a configuration of the heat exchanger 10 is the same as that of Embodiment 1. Therefore, description thereof is omitted, and the same or corresponding components are denoted by the same reference signs as Embodiment 1.

In the header 11 of the heat exchanger 10 according to Embodiment 5, at least a part of the communication passage 22*a* in one of two regions 41 and 42 of the flow passage 21 divided by the center plane 100 of the flat tube 2 and the communication passage 22*b* in the other of two regions is not connected to the insertion portion 23. In other words, the header 11 is provided with an insertion portion 23*a* which blocks one of the communication passage 22*a* in one region 41 and the communication passage 22*b* in the other region 42. For example, the insertion portion 23*a* blocks the communication passage 22*a* in one region 41 without directly communicating with the communication passage 22*a*.

Effect of Embodiment 5

As described above, in the header 11 of Embodiment 5, a distribution design of the two-phase refrigerant in accordance with an air volume distribution flowing through the heat exchanger 10 (see FIG. 1, etc.) is possible, and the heat exchanger performance can be improved. Incidentally, the insertion portion 23*a* which is not communicated with the communication passage 22*a* in one region 41 is at least communicated with the communication passage 22*b* in the other region 42.

Embodiment 6

Figure 33:
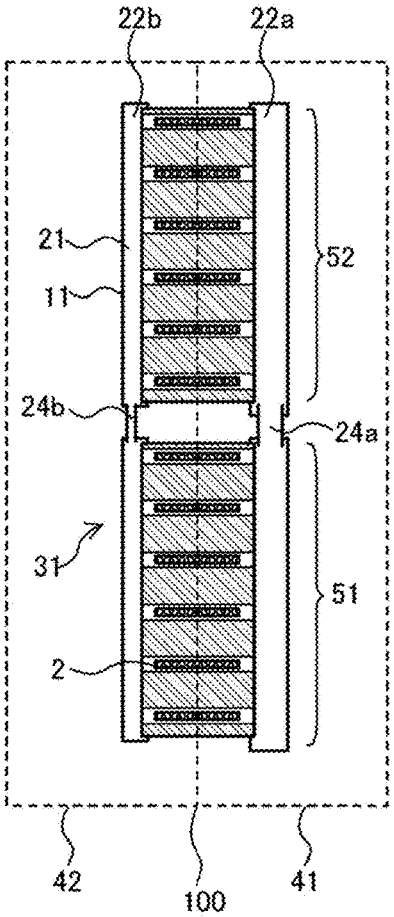
FIG. 33 is a schematic view showing a horizontal cross-section of the header of the heat exchanger according to Embodiment 6.

Next, a heat exchanger 10 according to Embodiment 6 will be described. FIG. 33 is a schematic view showing a horizontal cross-section of the header 11 of the heat exchanger 10 according to Embodiment 6. In Embodiment 6, the header 11 is partially modified, and a configuration of the heat exchanger 10 is the same as that of Embodiment 1. Therefore, description thereof is omitted, and the same or corresponding components are denoted by the same reference signs as Embodiment 1.

As shown in FIG. 33, the header 11 of the heat exchanger 10 according to Embodiment 6 includes a first heat transfer tube group 51 provided at the upstream side of the flow passage 21 of the header 11, and a second heat transfer tube group 52 provided at the downstream side of the flow passage 21. In addition, the header 11 according to Embodiment 6 includes two different refrigerant inlets which are a first refrigerant inlet 24*a* and a second refrigerant inlet 24*b*. The first refrigerant inlet 24*a* is connected to the communication passage 22*a* in one region 41. The second refrigerant inlet 24*b* is connected to the communication passage 22*b* in the other region 42. A passage diameter of the second refrigerant inlet 24*b* is smaller than a passage diameter of the first refrigerant inlet 24*a*.

Further, it is assumed that a part of or all of the flow passage 21 in which the first heat transfer tube group 51 and the second heat transfer tube group 52 are connected is regarded as the header 31. In this case, when viewed at a cross-section of the flow passage 21 in the first direction Y (not shown) which is a horizontal cross-section of the flow passage 21 of the header 31 shown in FIG. 33, a diameter of a part of the communication passage 22*b* at a position around the second refrigerant inlet 24*b* and between the first heat transfer tube group 51 and the second heat transfer tube group 52 is smaller than a diameter of a part of the communication passage 22*b* at the other position.

Effect of Embodiment 6

As described above, in the header 11 of Embodiment 6, the first refrigerant inlet 24*a* and the second refrigerant inlet 24*b* are configured such that the passage diameter of the second refrigerant inlet 24*b* connected to the communication passage 22*b* having a smaller passage cross-sectional area is smaller than the passage diameter of the first refrigerant inlet 24*a* connected to the communication passage 22*a* having a larger passage cross-sectional area. According to this configuration, the flow rate of the refrigerant flowing through the communication passage 22*b* can be reduced, and a sensitivity of two-phase gas-liquid distribution to inertial force having a positive correlation with refrigerant mass velocity can be reduced. Then, the heat exchanger performance can be improved in a wide operating capacity range.

Figure 34:
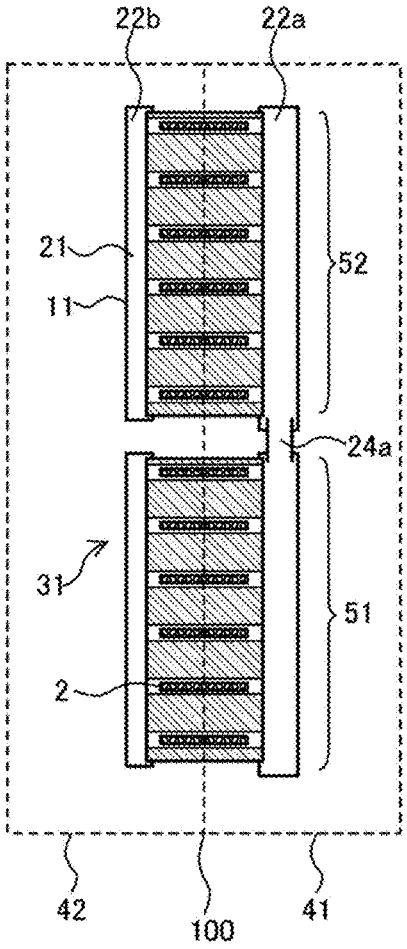
FIG. 34 is a schematic view showing a plan section of header of a modification of the heat exchanger according to Embodiment 6.
Figure 35:
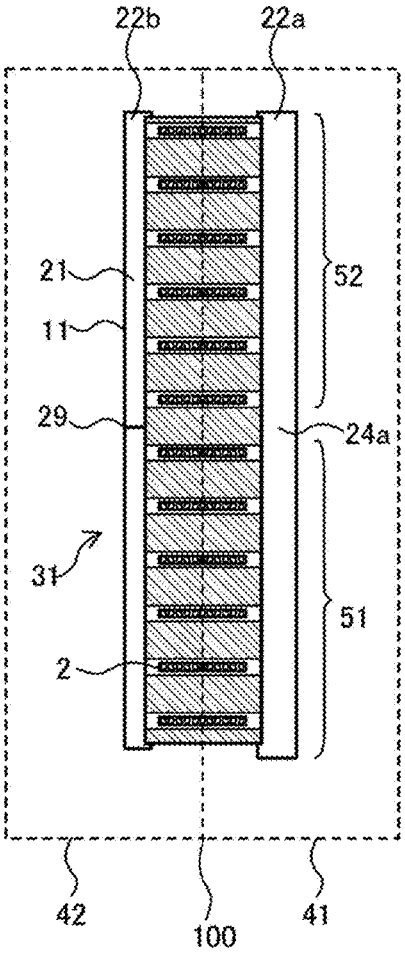
FIG. 35 is a schematic view showing a plan section of header of a modification of the heat exchanger according to Embodiment 6.

FIG. 34 is a schematic view showing a plan section of header 11 of a modification of the heat exchanger 10 according to Embodiment 6. FIG. 35 is a schematic view showing a plan section of header 11 of a modification of the heat exchanger 10 according to Embodiment 6. As shown in FIGS. 34 and 35, an amount of liquid flowing through the second refrigerant inlet 24*b* may be "0." The flow rate of the refrigerant flowing through the communication passage 22*b* of the header 11 may be "0," by omitting the second refrigerant inlet 24*b* as shown in FIG. 34, or by providing a partition 29 instead of the second refrigerant inlet 24*b* as shown in FIG. 35.

Figure 36:
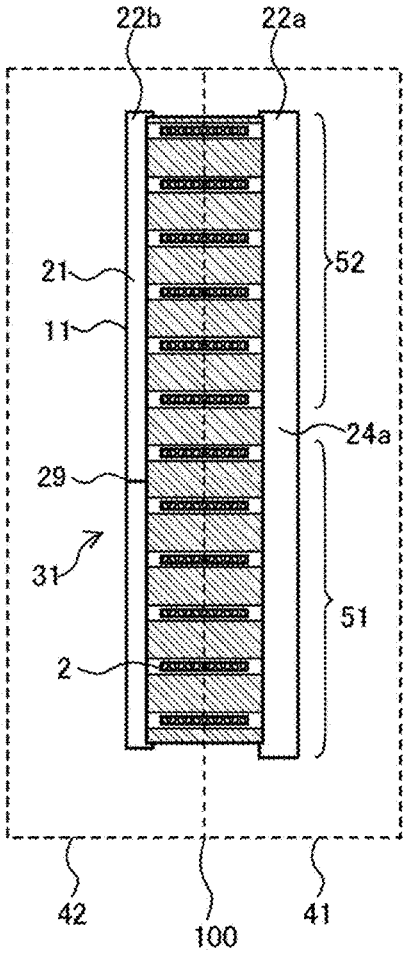
FIG. 36 is a schematic view showing a plan section of header of a modification of the heat exchanger according to Embodiment 6.

FIG. 36 is a schematic view showing a plan section of header 11 of a modification of the heat exchanger 10 according to Embodiment 6. As shown in FIG. 36, the communication passages 22*a* and 22*b* may be configured integrally with the communication passage of the header 30 of the heat exchanger at the upstream side.

Figure 37:
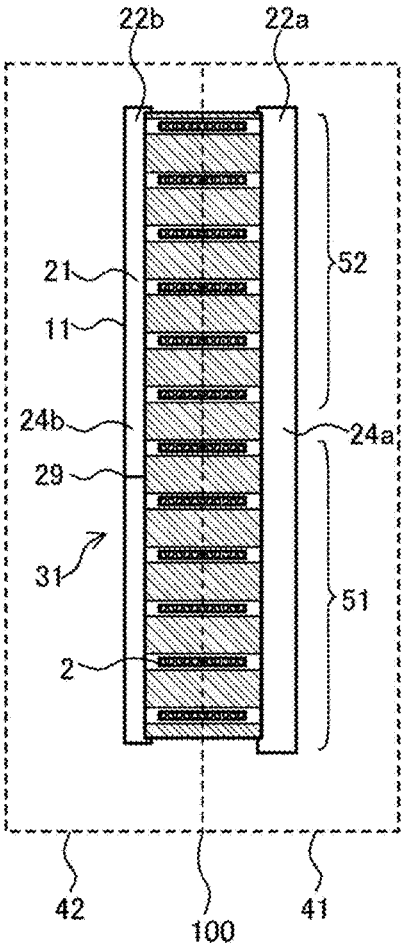
FIG. 37 is a schematic view showing a plan section of header of a modification of the heat exchanger according to Embodiment 6.

FIG. 37 is a schematic view showing a plan section of header 11 of a modification of the heat exchanger 10 according to Embodiment 6. As shown in FIG. 37, at least one flat tube at the most upstream side of the refrigerant flow may function as the second refrigerant inlet 24*b* by making some of the flat tubes 2 connected to the header 11 be flat tubes that constitute the first heat transfer tube group 51. According to this configuration, it is possible to supply the refrigerant to the communication passage 22*b* with reduced inertial force in the second direction Z. Therefore, the performance improvement effect by diffusion of the gas-liquid in the communication passage 22*b* can be improved.

Although a case where the heat exchanger includes two heat transfer tube groups including the first heat transfer tube group 51 and the second heat transfer tube group 52 is described above, the present disclosure is not limited thereto. For example, the heat exchanger 10 may include more than two heat transfer tube groups, and the above-described configuration may be different for each of the two heat transfer tube groups.

REFERENCE SIGNS LIST

1: fin, 2: flat tube, 3: refrigerant inlet, 4: contraction hole, 5: connection passage, 6: porous body, 7: partition portion, 10: heat exchanger, 11: header, 12: refrigerant pipe, 13: outdoor fan, 14: compressor, 15: four-way valve, 16: indoor heat exchanger, 17: expansion device, 18: bypass passage, 19: expansion device, 20: refrigerant passage, 21: flow passage, 22: communication passage, 22*a* communication passage, 22*b* communication passage, 23: insertion portion, 23*a*: insertion portion, 24: refrigerant inlet, 24*a*: first refrigerant inlet, 24*b*: second refrigerant inlet, 25: communication passage, 26; communication passage, 27: wall, 28: flow passage wall, 29: partition, 31: header, 41: region, 42: region, 43: region, 45; region, 51: first heat transfer tube group, 52: second heat transfer tube group, 61: liquid-based refrigerant, 62: gas-based refrigerant, 63: liquid refrigerant, 64: gas refrigerant, 80: cover, 81: cover, 90: penetration portion, 91: plate-shaped member, 92: plate-shaped member, 93: plate-shaped member, 94: plate-shaped member, 100: center plane, 101: center plane in short direction, 200: air-conditioning apparatus, 201: outdoor unit, 202: indoor unit, 501: header, 502: flat tube, 520: refrigerant passage, 521: flow passage, 522: communication passage, 523: insertion portion, BA: broad area, CA: contraction area.

The invention claimed is:

1. A heat exchanger comprising:

a plurality of flat tubes extending in a first direction and arranged with spacing from each other in a second direction perpendicular to the first direction, a cross-section of each of the plurality of flat tubes in the second direction being an elongated shape; and a header extending in the second direction and connecting to end portions of the adjacent flat tubes of the plurality of flat tubes in the first direction, the header being having inside a flow passage through which refrigerant flows, the flow passage including a plurality of partition portions each provided between the adjacent flat tubes and configured to block at least a part of the flow passage between the adjacent flat tubes to prevent the refrigerant from flowing in the second direction, a plurality of insertion portions formed between the adjacent partition portions, each of the plurality of insertion portions forming a space where the refrigerant flows in a third direction perpendicular to the first direction and the second direction, each of the plurality of flat tubes being inserted in to each of the plurality of insertion portions, a first communication passage allowing one ends of the adjacent insertion portions in the third direction to communicate with each other, and a second communication passage allowing an other ends of the adjacent insertion portions in the third direction to communicate with each other, a cross-sectional area of the first communication passage, of a cross-section perpendicular to the second direction, being larger than a cross-sectional area of the second communication passage, of a cross-section perpendicular to the second direction, the first communication passage being provided with a first refrigerant inlet connected to the flow passage and allowing the refrigerant to flow into the header.

2. The heat exchanger of claim 1, wherein a width of at least a connection portion of the insertion portion connected to the second communication passage in the second direction is smaller than a width of the partition portion in the second direction.

3. The heat exchanger of claim 1, wherein the plurality of flat tubes are arranged to extend in an up and down direction, and the header is provided at at least one of end portions of the plurality of flat tubes in an upper side and a lower side in the first direction.

4. The heat exchanger of claim 1, wherein, where a passage cross-sectional area of the first communication passage in the first direction is S1 and a passage cross-sectional area of the second communication passage in the first direction is S2, a quotient obtained by dividing S2 by S1 is greater than 0.15 and less than 0.8.

5. The heat exchanger of claim 1, wherein the plurality of flat tubes are inserted into the header with protruding only in the second communication passage when viewed in the first direction.

6. The heat exchanger of claim 1, wherein the header includes a contraction hole in a connection portion between the first communication passage and the plurality of insertion portions, the contraction hole being provided only in the first communication passage.

7. The heat exchanger of claim 1, wherein the header includes a connection passage connecting the first communication passage and the second communication passage, the connection passage being provided at at least one of the plurality of partition portions.

8. The heat exchanger of claim 1, wherein a part of the first communication passage or a part of the second communication passage of the header is blocked from the insertion portions.

9. The heat exchanger of claim 1, further comprising another heat exchanger provided at an upstream side in a flow direction of the refrigerant, wherein, the header is connected, through the first communication passage, to a header of the another heat exchanger at which flow passages of a plurality of flat tubes are merged, wherein, where a passage having a larger passage cross-sectional area in the first direction is the first communication passage, and a passage having a smaller passage cross-sectional area in the first direction is the second communication passage, a passage diameter of a second refrigerant inlet connecting the header of the another heat exchanger with the second communication passage is smaller than a passage diameter of the first refrigerant inlet connecting the header of the another heat exchanger with the first communication passage, or the second refrigerant inlet does not connect to the header.

10. The heat exchanger of claim 9, wherein, in the header, at least one of the plurality of the flat tubes provided at the upstream side in the flow direction of the refrigerant functions as the second refrigerant inlet.

11. An air-conditioning apparatus comprising a heat pump type refrigerant circuit which includes at least a compressor, a condenser, an expansion valve and an evaporator, wherein the condenser or the evaporator is the heat exchanger of claim 1.

12. The air-conditioning apparatus of claim 11, wherein the refrigerant is R32 refrigerant containing at least an olefin-based refrigerant, propane, DME (dimethyl ether), or a refrigerant having a lower gas density than that of R410A refrigerant.

* * * * *